US005533819A

United States Patent [19]

Watanabe et al.

[11] Patent Number: 5,533,819

[45] Date of Patent: Jul. 9, 1996

[54] CHARACTER BY CHARACTER THERMAL RECORDING DEVICE WITH INK SHEET FEED CONTROL

[75] Inventors: Youichi Watanabe, Machida; Toshihide Wada, Yokohama, both of Japan

[73] Assignee: Canon Kabushiki Kaisha, Tokyo, Japan

[21] Appl. No.: 390,814

[22] Filed: Feb. 16, 1995

Related U.S. Application Data

[63] Continuation of Ser. No. 180,773, Jan. 10, 1994, abandoned, which is a continuation of Ser. No. 845,834, Mar. 6, 1992, abandoned, which is a continuation of Ser. No. 477,111, Feb. 7, 1990, abandoned, which is a continuation of Ser. No. 94,757, Sep. 10, 1987, abandoned.

[30] Foreign Application Priority Data

| | | | |
|---|---|---|---|
| Feb. 12, 1986 | [JP] | Japan | 61-215156 |
| Aug. 4, 1987 | [JP] | Japan | 62-193761 |

[51] Int. Cl.[6] ..... B41J 33/36

[52] U.S. Cl. ..... 400/226; 400/232; 400/225; 347/217

[58] Field of Search ..... 400/120.01, 223, 400/225, 226, 227, 229, 231, 232, 233, 234, 235, 235.1, 236, 236.1, 236.2; 347/213, 215, 217

[56] References Cited

U.S. PATENT DOCUMENTS

| | | | |
|---|---|---|---|
| 4,641,150 | 2/1987 | Matsuura et al. | 400/120 |
| 4,709,242 | 11/1987 | Uchikata et al. | 400/231 |

FOREIGN PATENT DOCUMENTS

| | | | |
|---|---|---|---|
| 3403942 | 8/1985 | Germany | 400/120 |
| 62184 | 5/1981 | Japan | 400/120 |
| 84886 | 5/1982 | Japan | 400/232 |
| 201675 | 12/1982 | Japan | 400/120 |
| 8671 | 1/1983 | Japan | 400/120 |
| 67494 | 4/1983 | Japan | 400/120 |
| 212293 | 12/1984 | Japan | 400/231 |
| 187580 | 9/1985 | Japan | 400/232 |
| 199684 | 10/1985 | Japan | 400/120 |
| 2579 | 1/1986 | Japan | 400/120 |

*Primary Examiner*—David A. Wiecking

*Attorney, Agent, or Firm*—Fitzpatrick, Cella, Harper & Scinto

[57] ABSTRACT

A thermal recording device suitable for use in an electronic typewriter for printing characters on a printing paper by means of an ink sheet. The device has a thermal recording head adapted to be pressed onto the printing paper through the ink sheet so as to print the characters on the printing paper. The ink sheet is adapted to be fed by a reversible winding device. The recording device further has a first detector for detecting the length of the ink sheet fed by the feeding device in a period between a moment at which the feeding is commenced and a moment at which the thermal recording head reaches the first image recording position, and a second detector for detecting the length of the ink sheet fed by the feeding device in a period between a moment at which the thermal recording head leaves the final image recording position and a moment at which the thermal recording head is stopped. The feeding device is controlled in such a manner as to reverse the ink sheet in an amount corresponding to the lengths of feed of the ink sheet detected by the first and second detectors.

21 Claims, 19 Drawing Sheets

FIG. 15
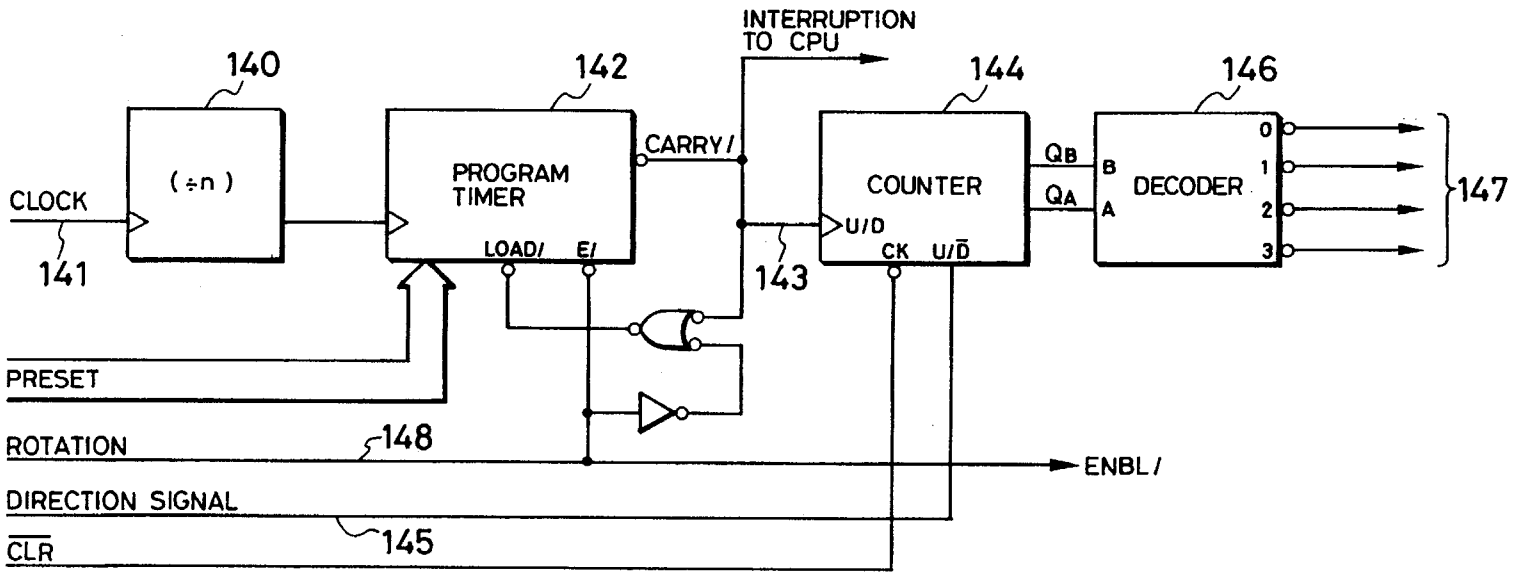
FIG. 19
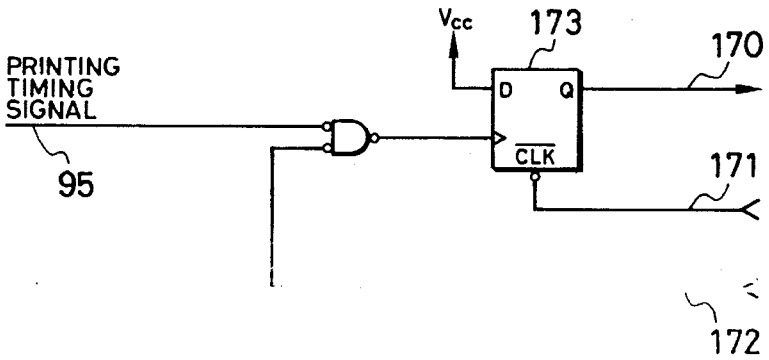
FIG. 16
| CONTENT | $D_3$ | $D_2$ | $D_1$ | $D_0$ |
|---|---|---|---|---|
| | $\overline{\phi 4}$ | $\overline{\phi 3}$ | $\overline{\phi 2}$ | $\overline{\phi 1}$ |
| REGISTER 3 | 0 | 1 | 1 | 0 |
| REGISTER 2 | 0 | 0 | 1 | 1 |
| REGISTER 1 | 1 | 0 | 0 | 1 |
| REGISTER 0 | 1 | 1 | 0 | 0 |

CHARACTER BY CHARACTER THERMAL RECORDING DEVICE WITH INK SHEET FEED CONTROL

This application is a continuation of application Ser. No. 08/180,773 filed Jan. 10, 1994, which is a continuation of application Ser. No. 07/845,834 filed Mar. 6, 1992, which is a continuation of application Ser. No. 07/477,111 filed Feb. 7, 1990, which is a continuation of application Ser. No. 07/094,757 filed Sep. 10, 1987 all now abandoned.

BACKGROUND OF THE INVENTION

1. Field of the Invention

The present invention relates to a thermal recording device suitable for use in printers, typewriters and word processor printers and, more particularly, to a thermal recording device of the type in which images are recorded on a recording sheet by means of an ink sheet carrying ink.

2. Related Background Art

Broadly, the recording systems adopted in various recording devices such as printers and typewriters are sorted into three types: namely, ink-jet recording system, wire-dot recording system and thermal recording system. The thermal recording system further can be classified into a thermal transfer type recording system in which characters and patterns are printed by an ink transferred from an ink ribbon, and heat-sensitive type system which makes use of a heat-sensitive recording paper. The thermal transfer type method which makes use of an ink ribbon is typically carried out by serial-type system in which a carriage which carries the ink ribbon together with the recording head is moved along the surface of the recording sheet. In operation of printers of thermal transfer serial printing device, the thermal head is pressed onto the recording paper through the intermediary of the ink ribbon and then the carriage is accelerated. The thermal transfer recording operation is effected only after the carriage is accelerated to a predetermined constant speed. The deceleration of the carriage is commenced after the recording is finished and the thermal head is moved away from the recording sheet after the carriage is stopped.

This known recording system is disadvantageous in that the ink ribbon is consumed wastefully because the ink ribbon is taken-up as a result of the movement of the carriage during acceleration and deceleration in which no recording is conducted. This problem is serious particularly in the case of printers adapted to print data in the form of discrete characters such as electronic typewriters. Namely, in such recording apparatus, the consumption of the ink ribbon per character is so large that the rate of utilization of the ink ribbon is significantly reduced resulting in an extremely uneconomical use of the ink ribbon.

More specifically, in the thermal transfer recording device of the serial recording type, the recording head is pressed onto a platen through the intermediary of the ink ribbon and the recording sheet, while the velocity of the carriage is still zero. This operation will be referred to as "head down" operation, hereinunder. After the head down operation, the carriage is accelerated and the recording, e.g., typing, is commenced after a predetermined constant speed is reached. Then, when the recording is finished, deceleration of the carriage is commenced and, when the the velocity is reduced to zero, the recording head is moved apart from the platen so as to be set at the retracted position. This movement of the head way from the platen will be referred to as "head up operation", hereinafter. When the head is in the down state, the ink ribbon is driven and taken up in synchronization with the movement of the carriage.

Since the head down and head up operations are conducted when the velocity of the carriage is zero, any risk for the portions of the recording sheet other than the recording portions to be contaminated is avoided.

In this recording operation, the ink ribbon is driven and taken up even during acceleration and deceleration of the carriage, though recording is not conducted actually in these periods, resulting in a wasteful use of the ink ribbon.

Under this circumstance, the present applicant has proposed an improved thermal transfer printer in the specification of Japanese Patent Application No. 166632/1981 filed on Oct. 19, 1981 and now laid-open as Japanese Patent Laid-Open No. 67494/1983 since Apr. 22, 1983. Briefly, this improved thermal transfer printer is of the type in which printing is effected by a thermal head carried by a carriage while an ink ribbon is driven, comprising reversing means for reversing the ink ribbon before the start of the printing by an amount which is at least part of the amount taken-up during the movement of the carriage to the printing position. In this improved thermal transfer printer, at least a part of the amount of the ink ribbon which has been taken-up during movement of the carriage to the printing position is reversed, thus attaining an economical use of the ink ribbon.

The present invention proposes a recording device of the type mentioned above, wherein the amount of ink ribbon wastefully used is further reduced.

SUMMARY OF THE INVENTION

Accordingly, an object of the present invention is to provide a thermal recording device which is improved in such a way as to reduce wasteful use of the ink sheet.

Another object of the present invention is to provide a thermal recording apparatus which can attain a higher efficiency of use of the ink sheet.

Still another object of the present invention is to provide a thermal recording device which can record images in a clean state without any contamination by ink.

A further object of the present invention is to provide a thermal recording apparatus which can improve the efficiency of the use of the ink sheet without causing the size of the device to be increased substantially.

A still further object of the present invention is to provide a thermal recording apparatus comprising first detecting means for detecting the length of the ink sheet taken up during the movement of the thermal head to the initial recording position, second detecting means for detecting the length of the ink sheet taken up during movement of the carriage from the last recording position to the position where it stops, and reversing means for reversing the ink sheet by the length equal to the sum of the lengths detected by the first and second detecting means.

A still further object of the present invention is to provide a thermal recording apparatus having detecting means for detecting non-recording portion of each character pattern and, when non-recording portion is detected, the carriage is moved, without taking up the ink sheet, to the position where it commences recording of the next character pattern.

These and other objects, features and advantages of the present invention will become clear from the following description of the preferred embodiments when the same is read in conjunction with the accompanying drawings.

BRIEF DESCRIPTION OF THE DRAWINGS

FIG. 15 is a block diagram schematically showing the construction of a driving circuit for controlling a ribbon motor;

FIG. 16 is an illustration of structure of data in registers Nos, 0 to 3;

FIG. 19 is an illustration of construction of the printing interruption signal generating circuit;

DESCRIPTION OF THE PREFERRED EMBODIMENTS

Preferred embodiments of the present invention will be described hereinunder with reference to the accompanying drawings.

Figure 1A:
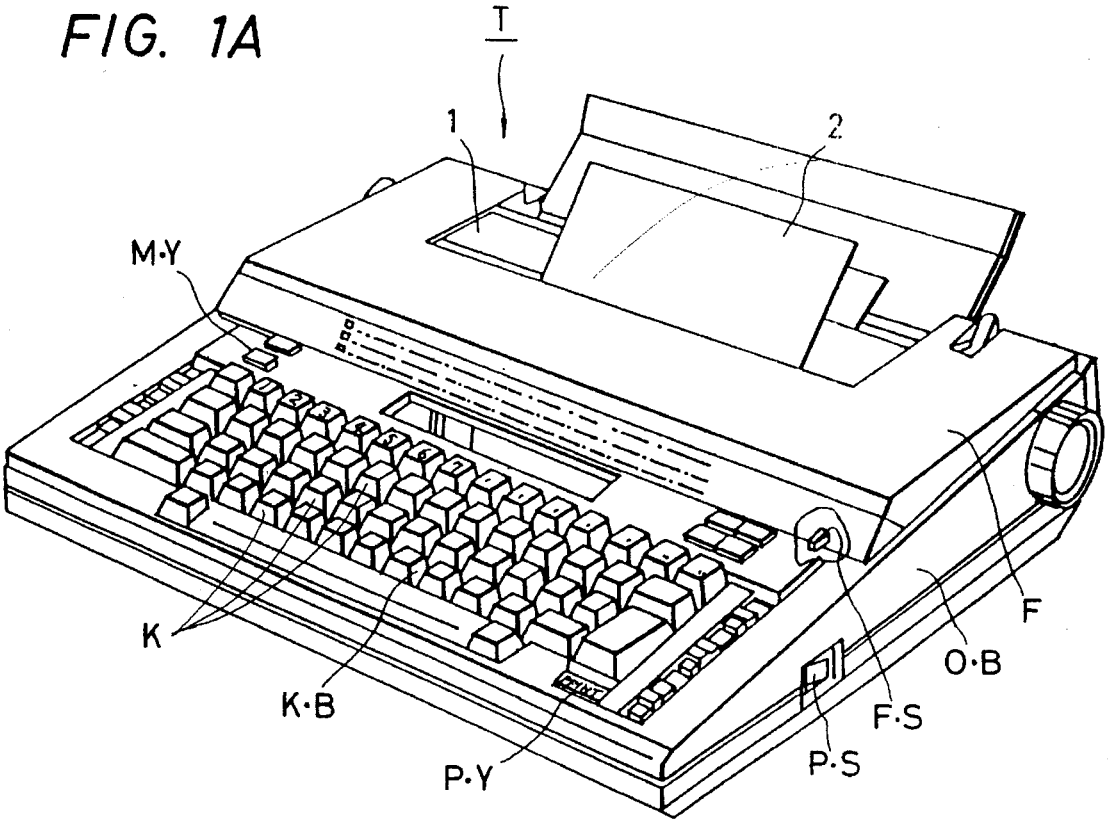
FIG. 1A is a perspective view of an electronic typewriter T to which various embodiments of the present invention can be applied effectively.

FIG. 1A shows a thermal transfer type electronic typewriter T to which various embodiments of the present invention can be applied suitably.

Referring to this Figure, the electronic typewriter has a platen 1 on which a print paper as a recording medium is set. The platen 1 is mounted in an outer body O.B on which is provided a keyboard K.B. The outer body O.B has a hood F which is swingable between an open position and a closed position. A hood switch F.S is adapted to be turned on and off in accordance with the state of the hood F. More specifically, the hood switch F.S is adapted for generating a signal for shifting a later-mentioned ink ribbon to a predetermined position when the hood F is opened. The same signal also is used for the purpose of locking the keyboard K.B when the hood F is in open position. The keyboard K.B has a mode key M.Y adapted for setting various operation modes such as ribbon mode, and a printer command key P.Y. The typewriter T shown in FIG. 1A has various operational sections such as a printing section, input section, display section, control section and input/output interface section. Needless to say, however, the electronic typewriter may be devoid of the input section and the display section.

This electronic typewriter T incorporates a thermal transfer printer which is an embodiment of the present invention. This thermal transfer printer is designed to record characters or other images by transferring an ink from an ink ribbon to the printing paper 2 on the typewriter. The thermal transfer printer has ink ribbon feeding/reversing means for feeding and reversing the ink ribbon, first detecting means for detecting the length of the ink ribbon fed by the feeding/reversing means during the movement of a thermal head to the initial recording position, second detecting means for detecting the length of the ink fed by the feeding/reversing means during the movement of the thermal head from the last recording position to the position where the ink ribbon sheet stops, and means for enabling the feeding/reversing means to reverse the ink ribbon by a length which is the sum of the lengths detected by the first and second detecting means, before the next printing is commenced.

In another aspect, the thermal printer as an embodiment of the thermal recording device of the invention has a carriage carrying a thermal head and an ink ribbon and adapted to run in the horizontal direction so as to print data along horizontal lines, detecting means for detecting non-recording portion of each character pattern, and means for allowing the carriage to move without feeding of the ink ribbon when any non-recording portion is detected.

In operation of the first-mentioned thermal transfer printer, the first detecting means detects the length of the ink ribbon fed by the feeding/reversing means from the moment at which the feeding is started by the feeding/reversing means until the moment at which the thermal head reaches the initial recording position. On the other hand, the second detecting means detects the length of the ink ribbon fed by the feeding/reversing means in the period between the moment at which the thermal head is moved from the final recording position and the moment at which the thermal head is stopped. The feeding/reversing means then operates to reverse the ink ribbon by a length corresponding to the sum of the lengths detected by the first and the second detecting means.

In the thermal transfer printer of the second aspect, feeding of the ink ribbon is not conducted while the carriage moves over a region corresponding to the non-recording portion of the character pattern to the position for starting printing of the next character.

Preferred embodiments of the respective thermal transfer printers mentioned above will be explained in detail hereinunder.

[Description of Function Blocks (FIG. 1B)]

Figure 1B:
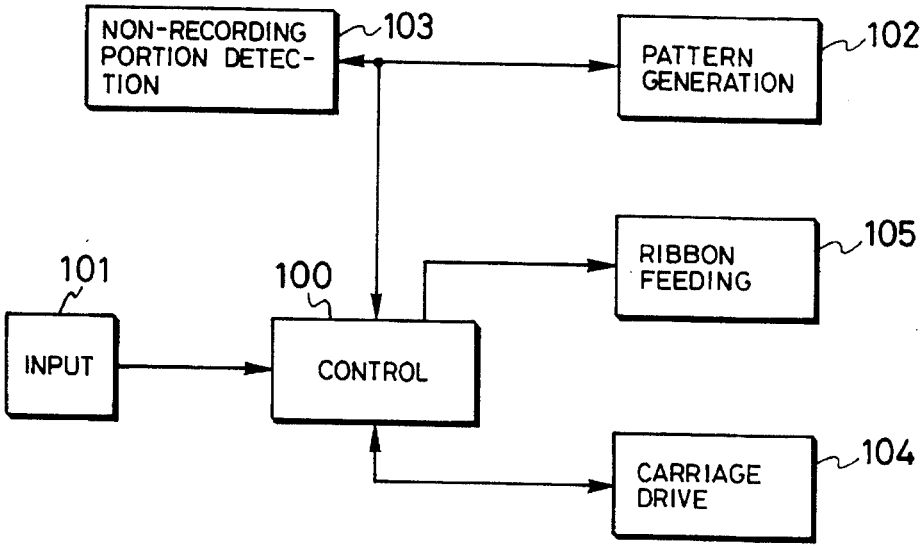
FIG. 1B is a block diagram showing the function of a thermal head printer according to the embodiment of the present invention.

Function blocks of a thermal transfer printer embodying the present invention are shown in FIG. 1B.

Thus, the thermal transfer printer has the following function blocks or units. A control unit 100 includes a CPU (Central Processing Unit) such as a microprocessor, various buffers and input/output ports. An input unit 101 is adapted to receive character codes and other data delivered from a host machine or document data input section such as a keyboard. The character codes and other data input through the input unit 101 are delivered to the control unit 100 so as to be stored in a memory in the control unit 100. A pattern generating unit 102 stores various pattern data corresponding to various character code data and is adapted to generate one of these pattern data in response to the input character code data. A non-recording portion detecting unit 103 is adapted to detect any non-recording portion of the pattern data stored in the pattern generating unit 102 and also to detect the amount of feeding of the ribbon when the carriage moves over a region corresponding to the non-recording portion of the pattern data during acceleration and deceleration of the carriage. The ink ribbon is fed and reversed by a feeding/reversing unit 105 which includes a later-mentioned ribbon motor and other associated parts. A carriage driving unit 104 is capable of driving the carriage carrying a thermal head and the ink ribbon along the printing line thereby to effect printing and spacing. In operation, the length of the ink ribbon, which has been fed by the feeding/reversing unit 105 without any printing in the period between the completion of recording of a character and the commencement of recording of a next character, is detected by the detecting unit 103. The non-recording portion detecting unit 103 then produces a signal corresponding to the detected length and the ribbon feeding/reversing unit operates in accordance with this signal so as to reverse the ribbon by the same length as that detected by the non-recording portion detecting unit 103.

At the same time, when any spacing is detected in the character code data by the non-recording portion detecting unit 103, the feed of the ink ribbon by the operation of the feeding/reversing unit 105 is suspended while the carriage is moved by the carriage driving unit 104 over the region corresponding to the detected non-recording portion to the position for commencing recording of the next character, whereby wasteful feed of the ink ribbon is minimized.

The operation of this embodiment outlined hereinabove will be explained in more detail.

[Description of Printing Mechanism (FIGS. 2 to 8)]

Figure 2:
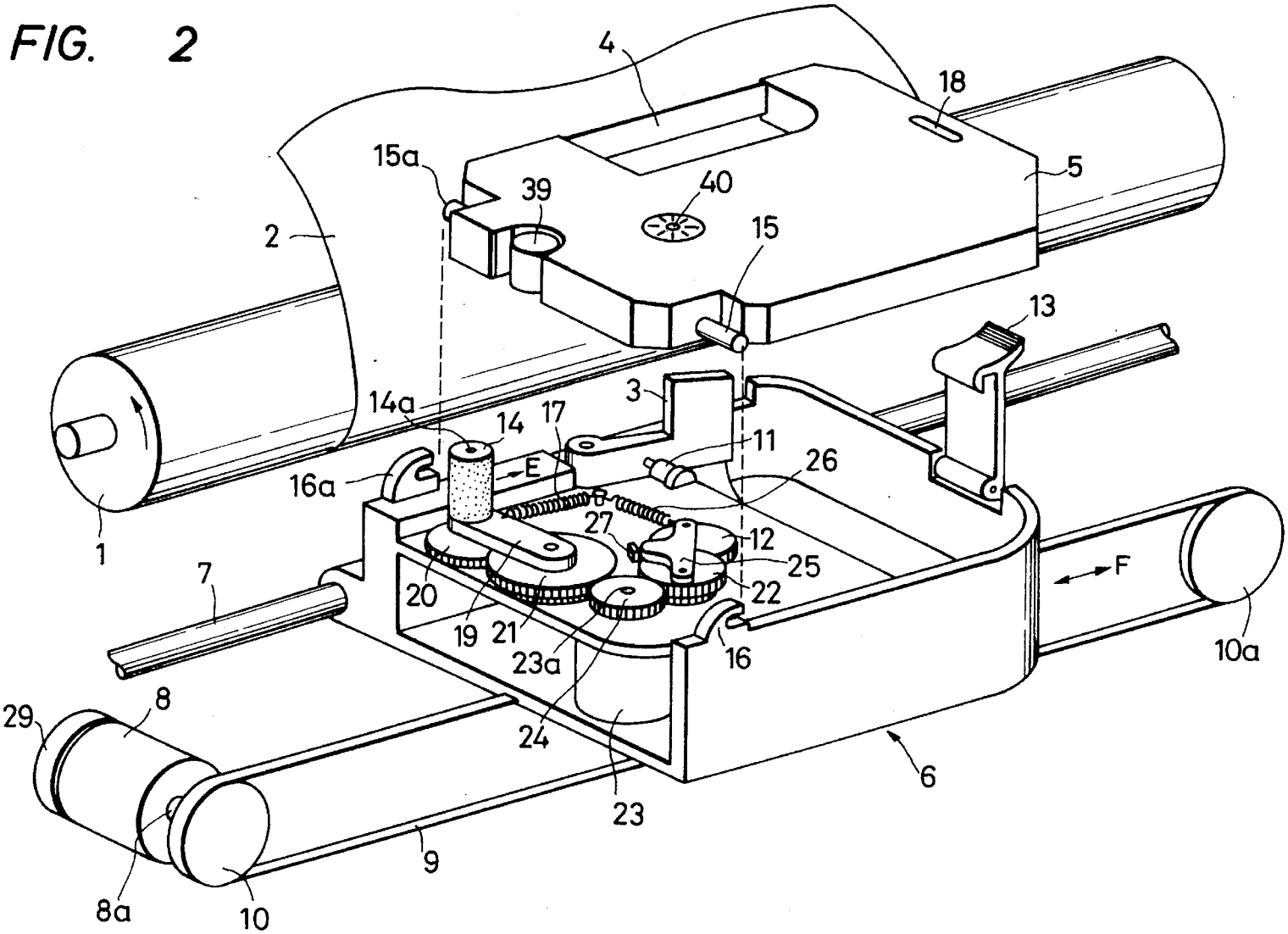
FIG. 2 is an illustration of a printing portion in the thermal transfer printer embodying the present invention.

FIG. 2 shows the detail of a printing mechanism incorporated in the described thermal transfer printer embodying the present invention.

The printing mechanism incorporates a roller-type platen 1 on which is wound a recording paper 2. The platen 1 is adapted to rotate so as to effect a line feed of the recording paper. The recording paper 2 is backed up by the platen 1 and is adapted to be pressed by a thermal head 3 through the intermediary of an ink ribbon 4, whereby character data or image data are recorded on the recording paper by an ink transferred from the ink ribbon due to action of heat. The long continuous ink ribbon 4 is set in a ribbon cassette 5. A reference numeral 8 designates a carriage motor having a rotor shaft 8*a* to which is fixed a pulley 10. A belt is wound around the pulley 10 and another pulley 10*a*. Both ends of the belt 9 are connected to the carriage 6 so that the carriage is moved reciprocatorily in the direction of arrow F along the platen 1 as the motor 8 operates in one and the other directions. To the rotor shaft 8*a* of the carriage motor 8 is attached a rotary encoder 29 which is adapted to deliver to the control unit 100 a signal indicative of the direction and speed of operation of the carriage motor 8. As stated before, the carriage 6 moves in the directions of arrows F in accordance with the rotation of the motor output shaft 8*a*, in the longitudinal direction of the platen 1 and substantially in parallel with the platen 1 along a guide shaft 7. That is, the carriage 6 moves reciprocatorily across the path of feed of the recording paper 2.

The aforementioned ink ribbon cassette 5 having the ink ribbon 4 set therein is demountably carried by the carriage 6 in such a manner that a portion of the ink ribbon exposed from the cassette is fed through a gap between the thermal head 3 and the recording paper.

Figure 10:
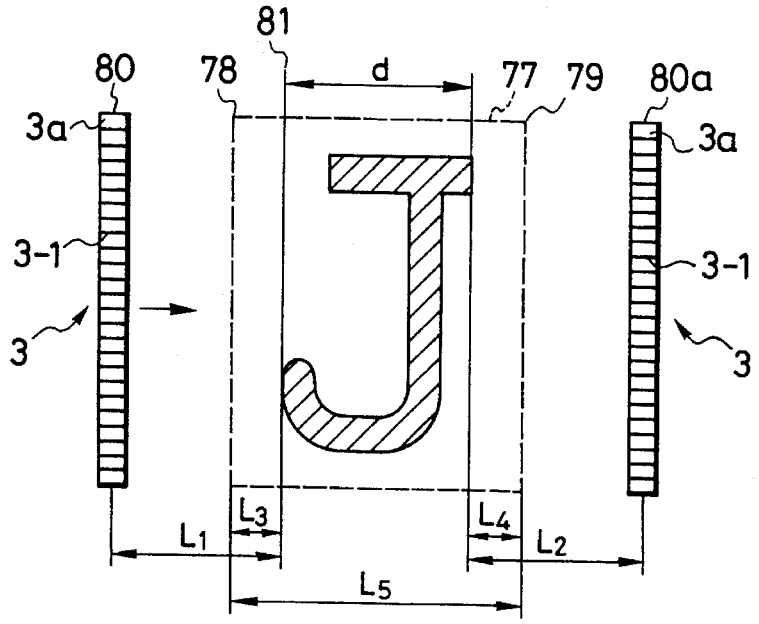
FIG. 10 is an illustration of an example of character printed by a thermal head.

As will be seen from FIG. 10, a vertical row of a plurality of heat generating resistors 3*a* is installed on the side of the thermal head 3 adjacent to the platen 1. The thermal head 3 is adapted to be actuated by a head actuator 11 between a head down position where it presses the platen 1 through the intermediary of the ink ribbon 4 and the recording paper and a head up position where it is spaced apart from the platen 1 and the ink ribbon 4. As stated before, the thermal head 3 is carried by the carriage 6 which is adapted to move across the path of feed of the recording paper 2. The head up operation and the head down operation are conducted when the relative velocity between the carriage 6 and the ink ribbon 4 is zero.

The internal structure of the ink ribbon cassette 5 will be described with specific reference to FIG. 3.

The ribbon cassette 5 is provided therein with a core 30 on which is placed a roll 31 of the ink ribbon. The ink ribbon 4 extracted from the roll 31 is retained by a pin 32 and another pin 33 on a lever 34 so as to be partially exposed to the outside of the body 5*a* of the cassette 5 through a window 35. The lever 34 is swingable about a shaft 36 and is biased by a spring 37 in the direction of an arrow a so as to take-up any slack in the ribbon 4.

The ink ribbon 4 exposed to the outside of the body 5*a* of the ribbon cassette 5 is adapted to be introduced again into the body 5*a* and is wound up by a roller 39 on a core 40. The roller 39 is rotatably attached to a pin 41 and is covered by a soft material such as rubber.

Figure 3:
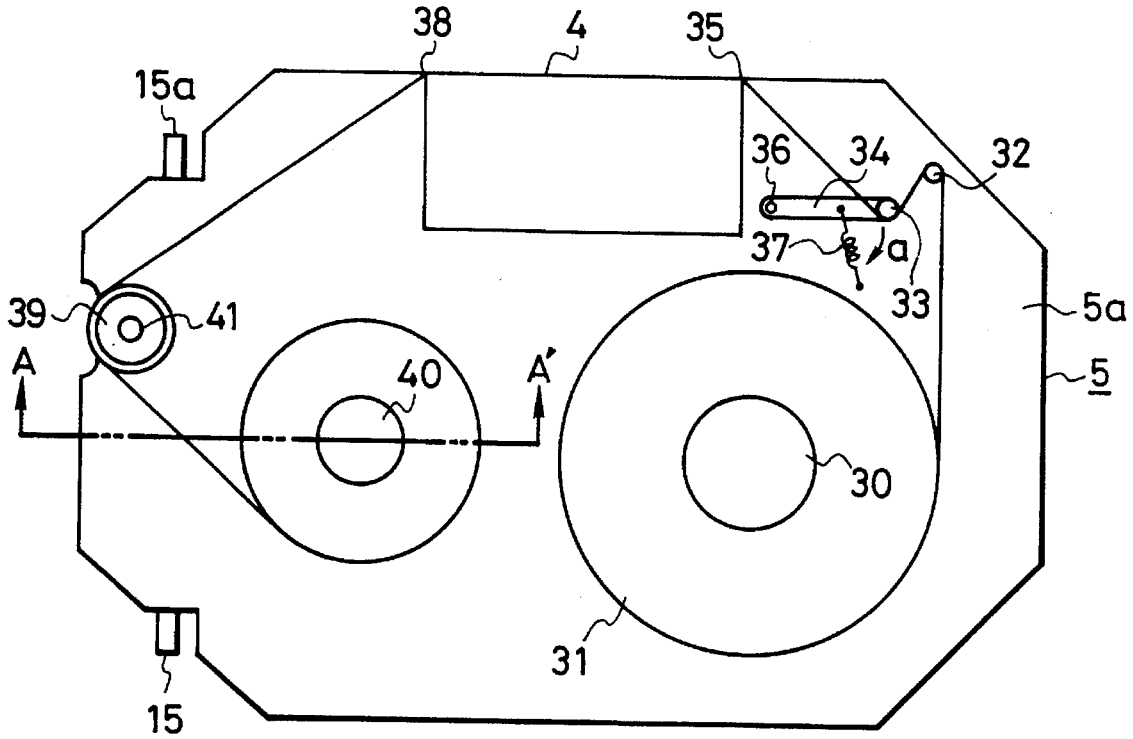
FIG. 3 is an illustration of the internal structure of an ink ribbon cassette.
Figure 4:
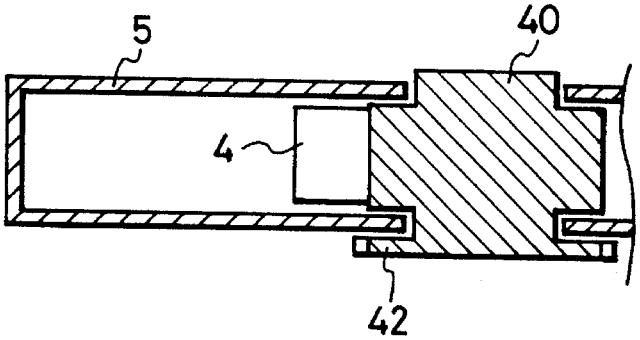
FIG. 4 is a sectional view of the ribbon cassette taken along the line A—A of FIG. 3.

FIG. 4 is a sectional view of the ribbon cassette taken along the line A-A' of FIG. 3.

As shown in this Figure, a gear 42 is provided on a lower portion of the core 40. The gear 42 is adapted to mesh with a gear 12 on the carriage 6 when the ribbon cassette 5 is properly set on the carriage 6, so as to be driven by the gear 12 thereby effecting winding (feeding) and rewinding (reversing) of the ink ribbon 4.

Figure 5A:
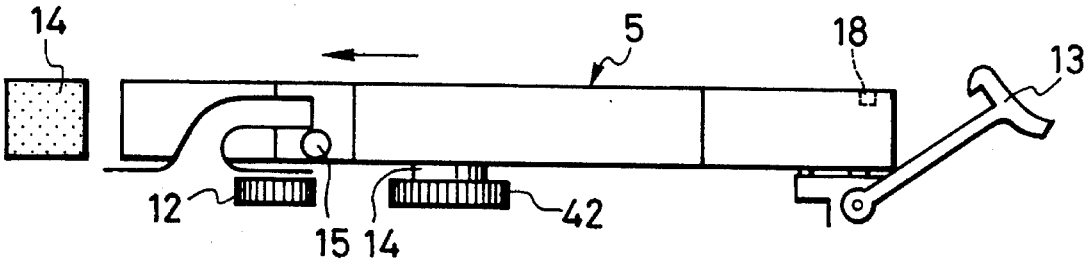
FIGS. 5A and 5B are sectional views showing the manner in which the ribbon cassette is mounted on a carriage.
Figure 5B:
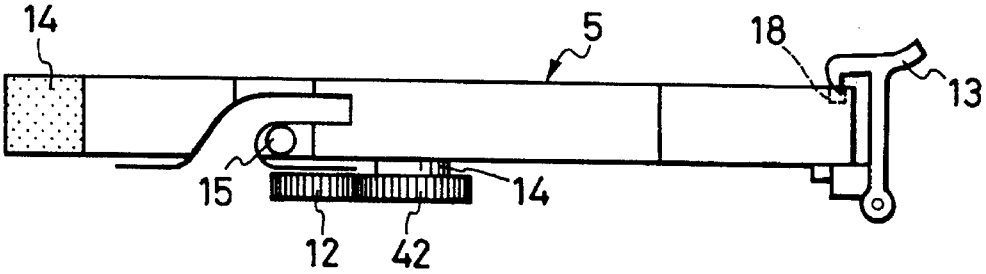

FIGS. 5A and 5B show the manner in which the ribbon cassette 5 is mounted on the carriage 6 of the ribbon cassette 5.

For the purpose of setting the ribbon cassette 5 on the carriage 6, the cassette 5 is moved in the direction of the arrow from the position shown in FIG. 5A so that the bosses 15, 15*a* (see FIGS. 2 and 3) of the ribbon cassette 5 are brought into engagement with the retainer portions 16, 16*a* on the carriage 6, whereby the ribbon cassette 5 is stably set on the carriage 6. In this state, as shown in FIG. 5B, a stopper 13 is received in a recess 18 of the cassette 5, whereby the cassette 5 is fixed to the carriage 6.

In the state shown in FIG. 5B, the gear 42 of the core 14 engages with the gear 12, while the roller 39 of the cassette 5 is pressed onto the roller 14 of the carriage 6. As will be seen from FIG. 2, the roller 14 is secured to a lever 19. The lever 19 is pulled by a spring 17 in the direction of arrow E. A gear 20 attached to the shaft portion of the roller 14 meshes with a gear 21 so as to be driven by the latter. The roller 14 is made of a metallic material and is knurled at its surface so as to exhibit a greater coefficient of friction. The roller 14 made of the metallic material serves also as a grounding means for allowing any electrostatic charge generated on the ink ribbon 4 to be discharged to the ground.

Figure 6A:
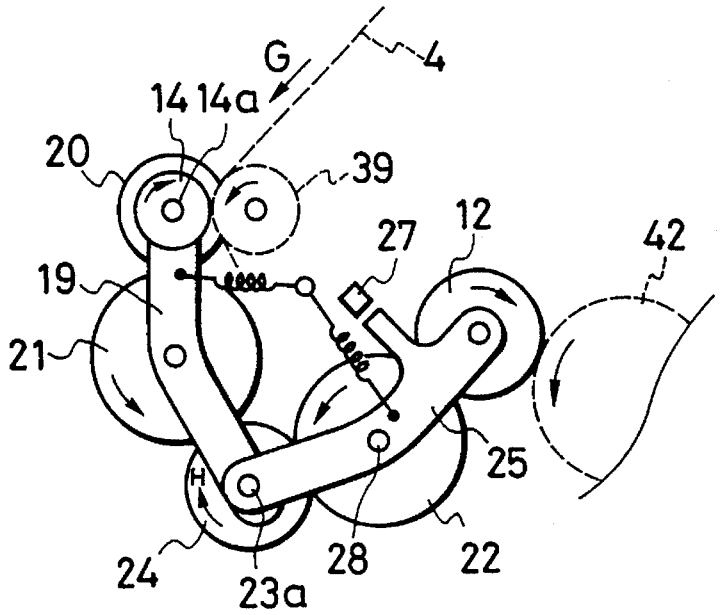
FIG. 6A is an illustration of gears and rollers in the state during taking up of an ink ribbon.

FIG. 6A shows the states of gears and rollers during feeding of the ink ribbon 4. A ribbon motor 23 has a rotor shaft 23*a* to which is fixed a gear 24. When the ribbon motor 23 operates to rotate the gear 24 in the direction of the arrow H, the clutch gears 21, 22 meshing with this gear are rotated, respectively, as indicated by the arrows. The gear 12 serving as a planet gear is carried by a member 25 and is adapted to revolve around the clutch gear 22 in accordance with the rotation of the clutch gear 22. More specifically, when the clutch gear 22 rotates counterclockwise as shown by the arrow, the gear 12 revolves around the clutch gear 22 clockwise while rotating clockwise about its own axis. This in turn causes the gear 42 on the core 40 to rotate counterclockwise, thereby causing the core 40 to wind up the ink ribbon 4, thereby feeding the latter.

In this state, the roller 14 and the roller 39 of the ribbon cassette are pressed to each other, so that the rotation of the ribbon motor 23 is transmitted to the roller 14 through the clutch gears 21 and 20, thereby to feed the ribbon 4 in the winding or feeding direction as indicated by arrow G.

Figure 6B:
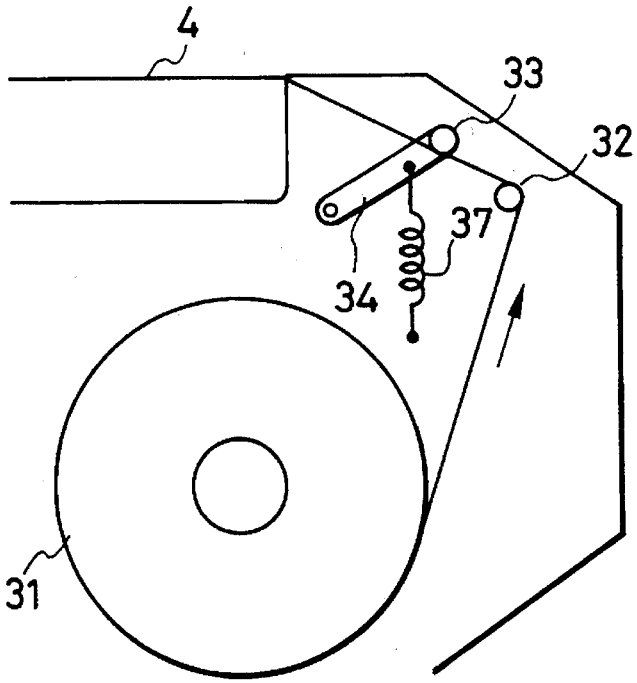
FIG. 6B is an illustration of the state of internal structure of the cassette during taking up of the ink ribbon.

The internal parts of the ribbon cassette 5 under this condition is shown in FIG. 6B. As will be seen from this Figure, the ink ribbon is tensed in the winding or feeding direction so that the lever 34 is urged upward by the tension in the ribbon 4.

Figure 7A:
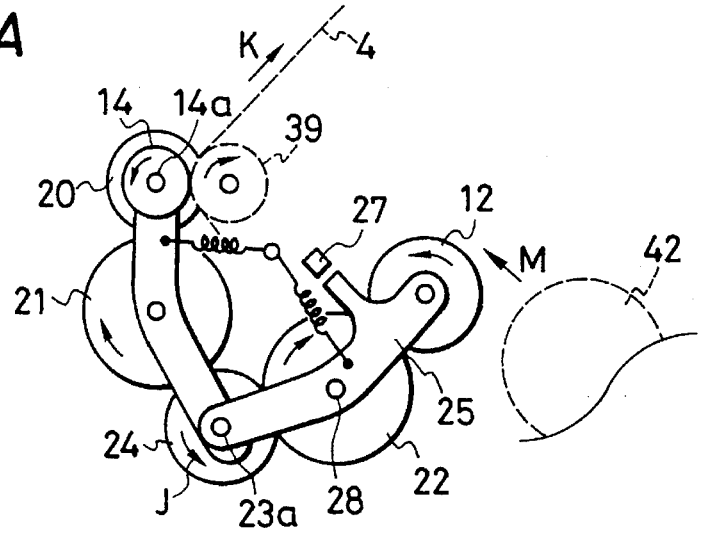
FIG. 7A is an illustration of the state of the apparatus during reversing of the ink ribbon.

FIG. 7A shows the state of the apparatus in the state for rewinding or reversing the ink ribbon 4. In this case, in contrast to the case shown in FIGS. 6A and 6B, the ribbon motor 23 operates counterclockwise so as to rotate the gear 24 in the direction of arrow J. In consequence, the roller 14 rotates counterclockwise through the clutch gears 21 and 20 so as to reverse the ink ribbon 4 as shown by arrow K. Meanwhile, the clutch gear 22 rotates clockwise so that the gear 12 rotates counterclockwise while moving in the direction of arrow M apart from the gear 42 until a projection on the member 25 is retained and stopped by the retaining portion 27. As a result, the engagement between the gear 42 on the core 40 and the gear 12 is dismissed thereby to free the core 40 on the cassette 5, whereby the ink ribbon 4 can be rewound or reversed.

Figure 7B:
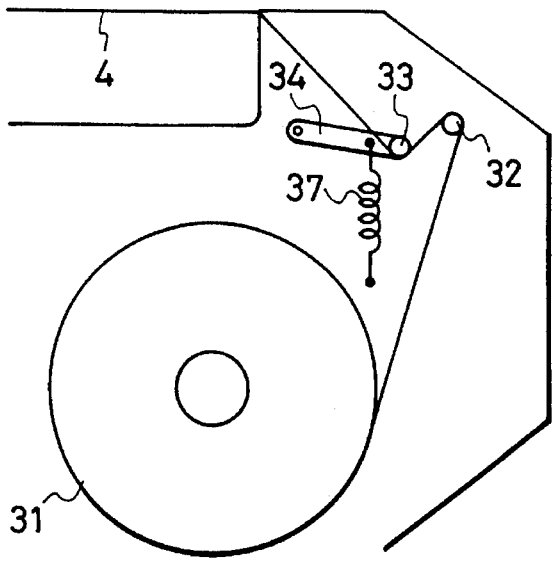
FIG. 7B is an illustration of the state of the internal structure of the ribbon cassette during reversing of the ink ribbon.

The internal parts of the ribbon cassette 5 in this state are shown in FIG. 7B.

As explained before, any slack of the ink ribbon 4 caused by the rewinding or reversing is absorbed by the movement of the lever 34 from the position shown in FIG. 6B to the position shown in FIG. 7B. In consequence, the slack of the ink ribbon is effectively taken up so as not to hinder the printing of the next character.

Figure 8:
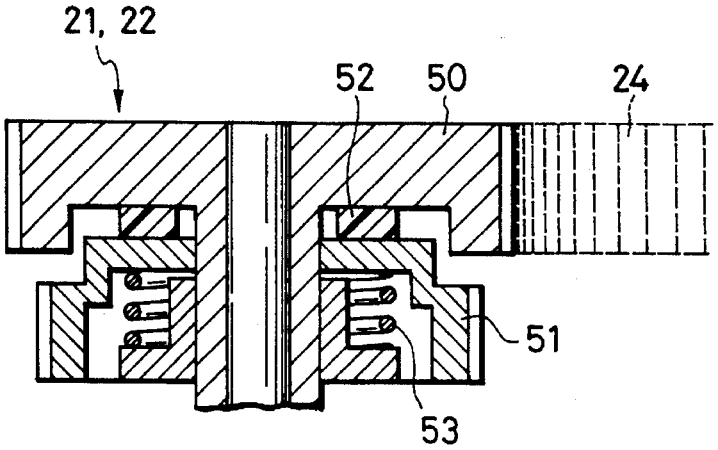
FIG. 8 is a sectional view of a clutch gear.

FIG. 8 is a sectional view of the clutch gears 21 and 22 for transmitting the rotation of the ribbon motor 23 to the gear 42 on the core 40 and the roller 14.

These clutch gears 21, 22 are constant-torque transmitting gears which are adapted to beg driven by a gear 50 meshing with the gear 24 on the rotor shaft 23*a* of the ribbon motor 23. More specifically, the torque of the gear 50 is transmitted to a gear 51 through a friction member 52 which is disposed between the gears 50 and 51 and resiliently pressed to these gears 50, 51 by the force of a spring 53. When the torque of the gear 50 is below the level of a limit torque borne by the frictional force on the friction member 52, the whole torque portion of the gear 50 is transmitted to the gear 51. However, when this torque exceeds the above-mentioned limit torque, the friction member 52 slips so as not to transmit excessive torque to the gear 51.

In the case of the clutch gear 21, the gear 20 meshes with the gear 51, whereas, in the case of the clutch gear 22, the gear 12 meshes with the gear 51. Thus, only the torque below the predetermined limit torque is transmitted between the gear 50 and the gear 51, i.e., between the ribbon motor 23 and the gear 12 and between the ribbon motor 23 and the gear 20. In consequence, any over-tensioning of the ink ribbon is prevented to avoid accidental cutting of the ink ribbon.

[Description of Thermal Transfer Printer (FIGS. 9 to 11)]

Figure 9:
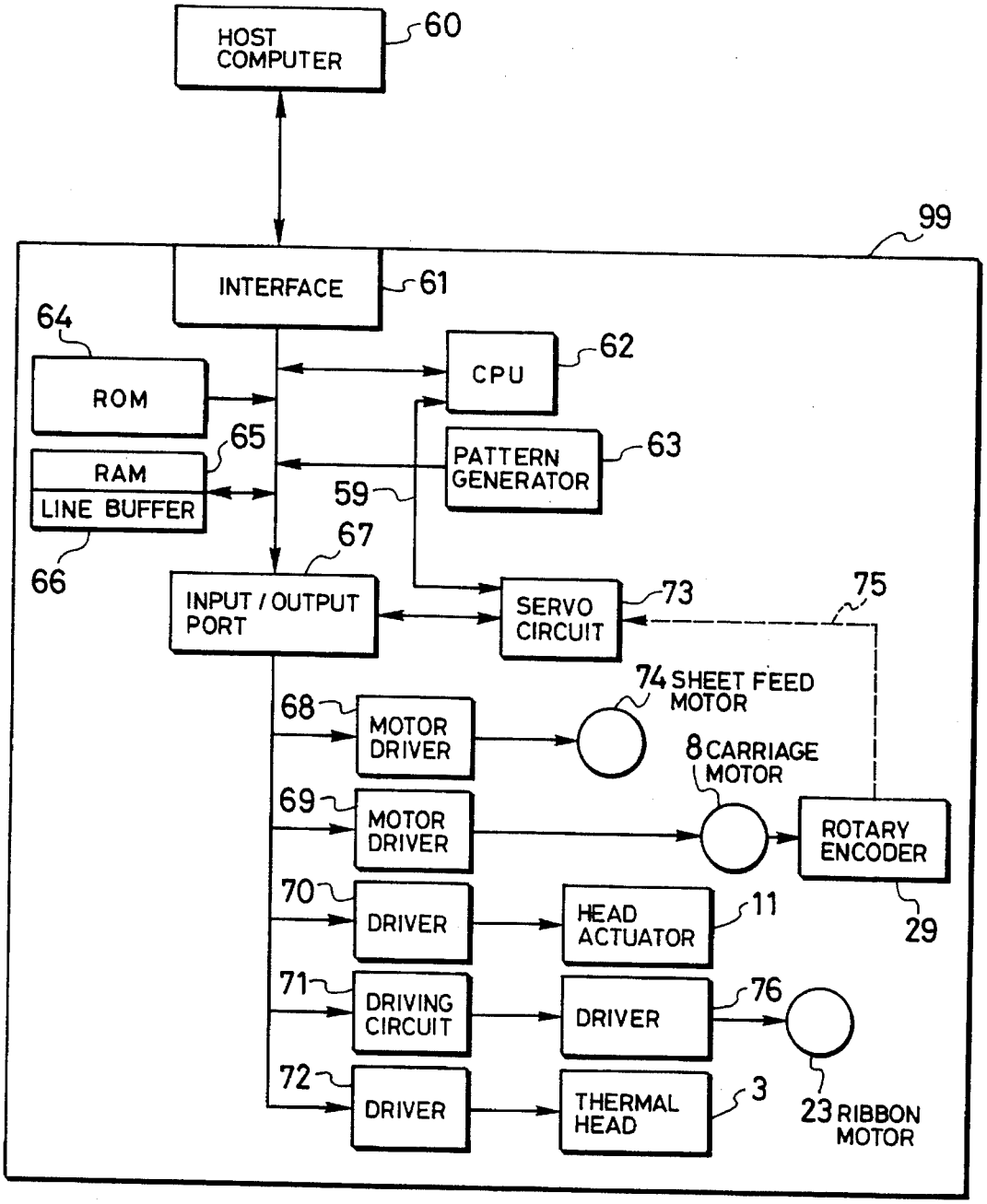
FIG. 9 is a block diagram schematically showing the construction of the thermal transfer printer embodying the present invention.

FIG. 9 is a block diagram schematically showing the construction of the thermal transfer printer 99 as the embodiment. A host computer 60 is adapted for outputting various control commands and printing data to the thermal transfer printer. The exchange of data between the host computer 60 and the printer 99 is conducted through an interface section denoted by 61. A CPU (Central Processing Unit) 62 is adapted for conducting the control of the printer 99. The CPU receives, through a control line 59, various interruption signals such as a printing timing interruption signal from a servo circuit 73, an interruption from a later-mentioned driving circuit 71 for driving the ink ribbon motor 23, and interruption signals from a timer and other external devices which are not shown.

ROM 64 stores various control programs to be executed by the CPU 62 and other data. These programs are shown by flow charts in FIGS. 20 to 22. A reference numeral 65 denotes a RAM which is used as a work area of the CPU 62. The RAM 65 includes a buffer which stores print data delivered by the host computer 60, a line buffer 66 for storing one-line print data in the form of dot image, and so forth. A pattern generator 63 storing pattern data concerning patterns of various characters and symbols may be comprised of replaceable cartridge-type ROM.

In operation, the CPU 62 receives coded printing data from the host computer 60 and enables the pattern generator 63 to develop the coded printing data into character patterns. The character patterns corresponding to the input printing data is stored in the line buffer 66. As the print data is formed, motor driving signals are delivered to the respective motor drivers thereby starting motors such as the carriage motor 8, sheet feed motor 74 and the ribbon motor 23. The print data developed into the character patterns is delivered to the thermal head 3 in synchronism with the operation of the carriage motor 8, whereby the printing is executed.

The head down operation and the head up operation conducted when the printing operation is started and finished are effected by the head actuator 11. The rotation of the rotor shaft of the carriage motor 8 is detected by the rotary encoder 29 which produces a detection signal 75. The detection signal 75 is delivered to a later-mentioned servo circuit 73 so as to be used in the control of the carriage motor 8.

Figure 11:
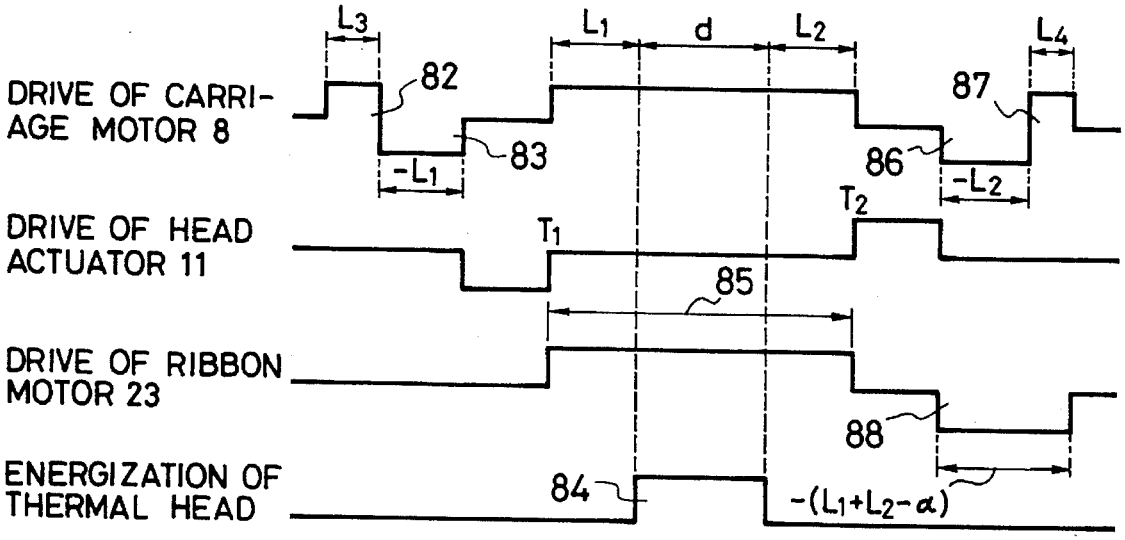
FIG. 11 is an example of timing of printing operation for conducting the printing shown in FIG. 10.

FIG. 10 shows an example character printed by the thermal head 3, while FIG. 11 shows an example of operation timing for printing the character shown in FIG. 10.

Referring to FIG. 10, a character pattern "J" is stored in the pattern generator 63. Spaces of lengths L3 and L4 are contained on both sides of the character pattern 77. It is assumed here that the row of the heat-generating resistors 3-1 on the thermal head 3 is positioned at the print start position 78 for printing the character pattern 77 read from the pattern generator 63.

As the command for printing the character "J" is input, the thermal head 3 is first moved in the printing direction, i.e., to the right as viewed in this Figure, by a distance corresponding to the space L3, thereby bringing the thermal head 3 to a position corresponding to the starting point of the character pattern to be printed. This movement of the carriage 6 is shown by 82 in FIG. 11. As a result of this movement, the row 3-1 of heat generating resistors **3*a* is brought to the left end 81 of the dot pattern "J" to be formed. Subsequently, in order to allow the carriage 6 to be accelerated through the distance L1, the carriage 6 and, hence, the thermal head 3 is returned by a distance L1 to the position shown by the numeral 80. This reversing operation of the carriage driving motor is indicated at 83 in FIG. 11**.

Thereafter, the carriage 6 and, hence, the thermal head 3 are accelerated through the distance L1 from the position indicated by the numeral 80. The head down operation for driving the thermal head 3 to the head down position is commenced before the time of start of acceleration (moment $T_1$ shown in FIG. 11). As shown in FIG. 11, the driving of the head actuator 11 ceases at moment $T_1$; the thermal head 3 is then in the head down position. When the constant speed of the thermal head 3 is reached after the completion of acceleration of the carriage 6, the thermal head 3 is energized through the period 84 corresponding to the distance d, thereby printing the character "J". Namely, the ink on the ink ribbon 4 is transferred to the recording paper 2 by the heat generated in the thermal head in conformity with the character pattern "J", whereby the character "J" is printed on the recording paper 2.

After the thermal head 3 is moved over a distance corresponding to the width d of the dot pattern, the carriage 6 and, hence, the thermal head 3 are decelerated through the distance L2 and then stopped at the moment $T_2$ in FIG. 11. The position at which the thermal head is stopped is indicated by **80*a* in FIG. 10. The head actuator 11 is driven to effect the head up operation at this moment $T_2$. The period between the moments T1 and T2 is indicated at 85 in FIG. 11. In this period, the thermal head 3 is kept in the down position, so that the ink ribbon is wound or fed in accordance with the movement of the carriage 6**.

After the stopping of the carriage 6, the carriage 6 is moved backward over the deceleration distance L2 as shown by 86 in FIG. 11, and then moved forward by the distance corresponding to the space L4 on the right side of the character pattern 77, as shown by 87 in FIG. 11.

As will be understood from the foregoing description, the ink ribbon 4 is wound or fed by a length (L1+L2+d), although the length actually consumed for printing the character "J" is d, resulting in a wasteful use of the ink ribbon 4. In the described embodiment of the thermal transfer printer, however, the ink ribbon 4 is rewound or reversed by the length (L1+L2) after the completion of printing of each character, thereby to minimize the amount of the ink ribbon used wastefully. This rewinding operation is indicated by a numeral 88 in FIG. 11. Taking into account any error which may be involved in the amounts of movement during forward feed and reversing of the ink ribbon, the length of rewinding or reversing is set to be (L1+L2=$\alpha$). The term $\alpha$ represents a margin which is provided for preventing any overlap between the region of the ink ribbon 4 already used and the region of the ink ribbon 4 which is going to be used.

[Driving of Carriage Motor (FIGS. 12 to 14)]

Figure 12:
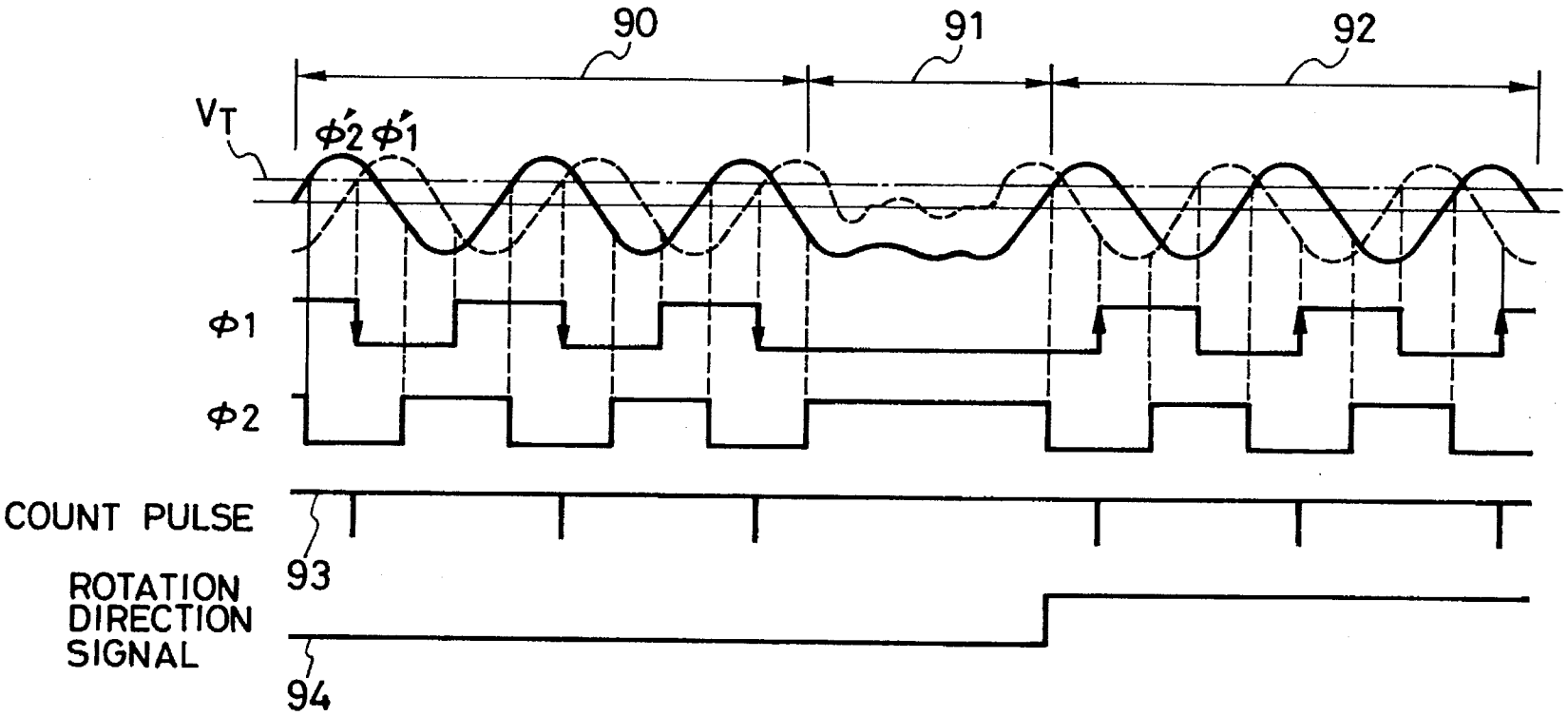
FIG. 12 is an illustration of example of the timing of a rotation detection signal output from a rotary encoder and the timing of a signal generated in a servo circuit.

FIG. 12 shows examples of timing of the rotation detection signal 75 output from the rotary encoder 29 and the timing of signal generated in the servo circuit 73.

The rotary encoder 27 attached to the rotor shaft **8*a* of the carriage motor 8 is adapted to generate a couple of sine wave signals $\phi_1'$ and $\phi_2'$ having a 90° phase difference therebetween, in synchronization with the operation of the carriage motor 8. The servo circuit 73** operates to conduct binary-coding of these sine wave signals $\phi_1'$ and $\phi_2'$ by a threshold voltage $V_T$ thereby forming pulse signals $\phi_1$ and $\phi_2$.

Referring to FIG. 12, a numeral 90 denotes the period through which the carriage motor 8 operates clockwise, i.e., the period in which the carriage 6 moves in the printing direction, while a numeral 91 designates a period in which the carriage motor 8 does not operate. A numeral 92 denotes the period through which the carriage motor 8 is reversed (counterclockwise) so as to drive the carriage 6 in the direction counter to the printing direction. When the phase of the pulse $\phi_2$ is 90° ahead the pulse $\phi_1$, the carriage motor 8 operates clockwise, whereas, when the phase of the pulse $\phi_2$ is 90° aback the pulse $\phi_1'$, the carriage motor 8 operates counterclockwise.

During the clockwise operation of the carriage motor 8, a count pulse 93 is generated at each fall of the pulse $\phi_1$ while the pulse $\phi_2$ is at the low level, whereas, when the carriage motor 8 operates counterclockwise, the count pulse is generated at each rise of the pulse $\phi_1$ while the pulse $\phi_2$ is at the low level. A reference numeral 94 denotes a signal representing the direction of operation of the carriage motor 8. The period of the pulses $\phi_1$ and $\phi_2$ is determined to correspond to the travel of the carriage 6 by 1/360 inch.

Figure 13:
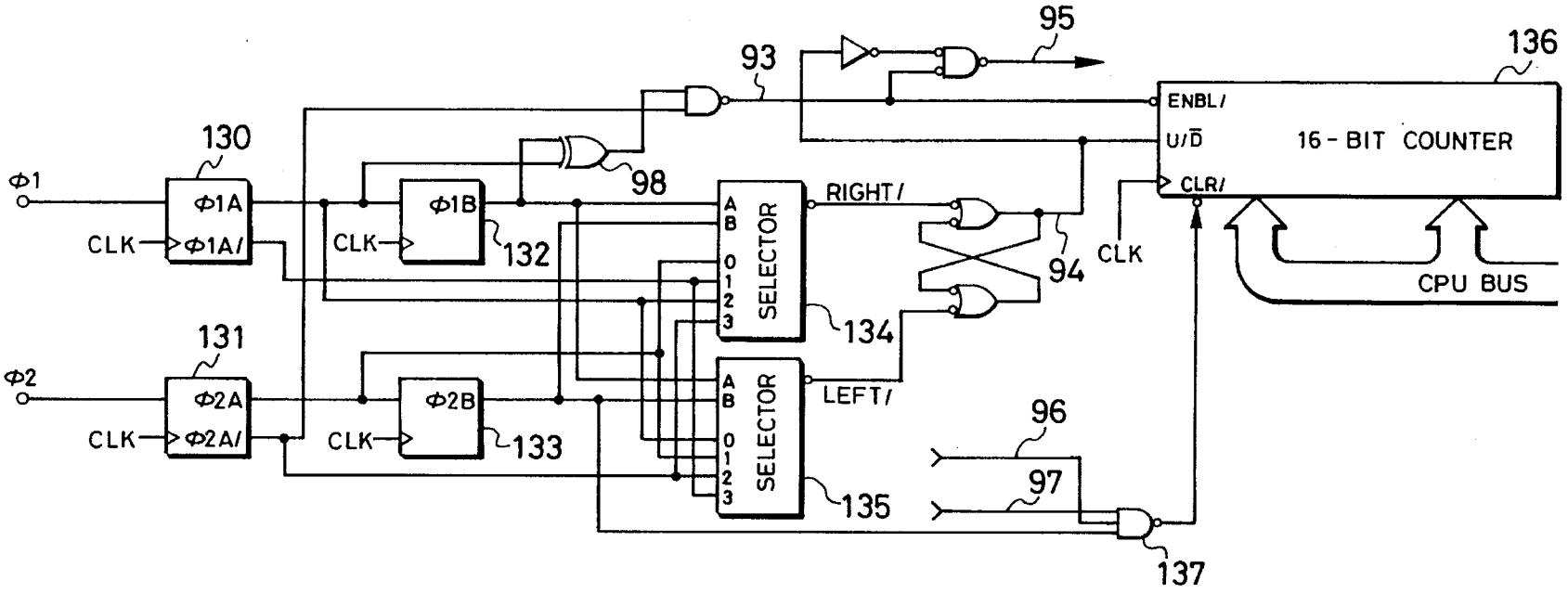
FIG. 13 is an illustration of a circuit for forming count pulses and direction signal by making use of pulses $\phi_1$ and $\phi_2$ produced by the rotary encoder.
Figure 14:
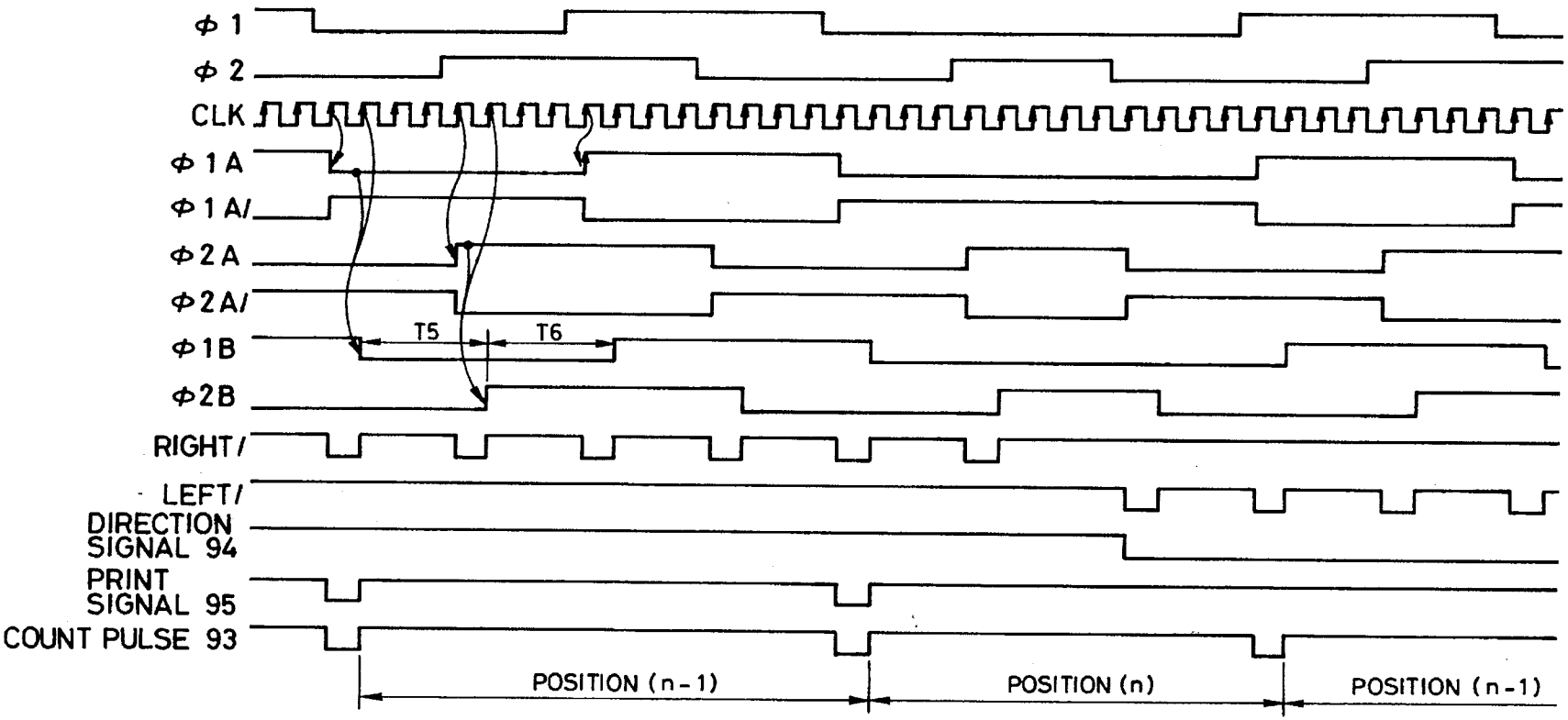
FIG. 14 is an illustration of the timing of signals in the circuit shown in FIG. 13.

FIG. 13 is an illustration of a circuit incorporated in the servo circuit 73 and adapted to produce the count pulse and the operation direction signal in response to the pulses $\phi_1$ and $\phi_2$, while FIG. 14 illustrates the timing of operation of this circuit.

Referring to FIG. 13, D-type flip-flops 130 to 133 receive CLK as the clock signals. Numerals 134 and 135 denote selectors, adapted to select one of the input signals 0 to 3 in accordance with the signal received by the select terminal AB and to deliver the thus selected input signal after inversion.

For instance, in the period T5 shown in FIG. 14, the AB inputs to the selectors 134, 135 are "00" so that the selectors 134, 135 select the input "0". In consequence, an output (RIGHT/) which is a signal obtained by inversion of the signal $\phi$2A, is derived from the selector 134, while the output (LEFT/) from the selector 135 takes the high level. Similarly, in the period T6, the AB inputs are A=0 and B=1 so that the selectors 134 and 135 produce, as their outputs, signals obtained by inverting the inputs thereto. In consequence, the RIGHT/signal becomes $\phi$1A/signal, while the LEFT/signal is still maintained at the high level. The mark (slash) represents a low active signal.

A reference numeral 95 represents a printing timing signal which is output at the same timing as the count pulse 93 during the rightward movement of the carriage 6. An EXCLUSIVE OR circuit 98 delivers, in response to each change in the state of the pulse $\phi$1, a high level signal which lasts for a time length corresponding to the period of the CLK signal. This signal is delivered to a NAND circuit 99 which produces the logical product (AND) of this signal and the $\phi$2A/signal, whereby the count pulse signal 93 is formed. The direction signal 94, when at high level, represents that the carriage 6 is moving to the right and, when at low level, indicates that the carriage 6 is moving to the left. In consequence, a 16-bit counter counts up and down, respectively, when the carriage 6 moves to the left and right.

A reference numeral 96 designates a signal which is output when the carriage 6 is on the left end of its stroke, while a reference numeral 97 denotes a signal which is set high when the carriage 6 is at the reference position. The 16-bit counter 136 is cleared when these signals 96, 97 and the $\phi$2B signal (this signal is set high in the region around the center position) are set high simultaneously. This counter 136 is connected to the CPU BUS through the input/output port 67 so that the CPU 62 can monitor the position on the carriage 6 on the basis of the content of the counter 136. During leftward stroking of the carriage, the selector 135 outputs LEFT/signal so that the direction signal 94 is set low.

[Control of Drive of Ink Ribbon Motor (FIGS. 15 to 19)]

FIG. 15 is a block diagram schematically showing the construction of the driving circuit 71 for driving and controlling the ribbon motor 23.

A reference numeral 140 denotes a counter which prescales the clock signal 141 into 1/16 frequency or 1/32 frequency thereby producing clock signals for a program timer 142. The program timer 142 is connected to the BUS of the CPU 62 through the input/output port 67 and is adapted to be preset by the CPU 62. The program counter 142 conducts counting in response to the rise of the clock signal from the counter 140 and outputs a carry signal 143 each time the count value overflows this counter. The carry signal 143 is used as the load signal for loading a preset value on the program timer 142 or the count clock signal for the counter 144. The carry signal 143 also delivers an interruption demand to the CPU 62. Upon receipt of this interruption, the CPU presets the program timer 142 thereby enabling the ribbon motor 23 to be driven.

The CPU 62 outputs a rotation direction signal 145 which is set high and low, respectively, when the ribbon motor 23 operates in the winding or feeding direction and when the same operates in the rewinding or reversing direction. The counter 144 counts up and down in response to this rotation direction signal 145. The decoder 146 decodes the 2-bit output from the counter 144. For instance, when the AB inputs are "00", the decoder 146 outputs only the 0 output at low level, whereas, when the AB inputs are (A=1, B=0), it outputs only the 1 output at the low level. This signal 147 is used as the select signal for a register 150 which will be mentioned later. A numeral 148 denotes an ENABLE signal which is set low only when the ribbon motor 23 is operating.

When the CPU 62 gives a rotation command to the ribbon motor 23, the present stopping phase of the ribbon motor 23 is excited for a predetermined time before the rotor of the ribbon motor 23 starts to rotate. This can be achieved by writing, in the program timer 142, a preset value corresponding to the length of time through which the present stopping phase of the motor is energized. Assuming here that the time of exciting the present stopping phase and the output period of the counter 140 are set to be 3 msec and 32 μsec, respectively, and that the program timer 142 is an 8-bit timer the value written in the program timer 142 by the CPU 62 is represented as follows:

$$FF(Hex)-(3000\ \mu sec/32\ \mu sec)=Al(Hex)$$

where (Hex) represents hexadecimal digit.

FIG. 16 shows the data structures of register Nos. 0 to 3 selected by the select signal 147.

Each register stores the signals for exciting four phases of the ribbon motor 23 in a low active form. When the contents of the registers are read in an ascending manner, i.e., from the register No. 0 up to the register No. 3, the ribbon motor 23 operates in the direction for winding or feeding the ribbon, whereas, when the contents of the registers are read in the descending manner, i.e., from the register No. 3 down to the register No. 0, the ribbon motor 23 operates in the direction for rewinding or reversing the ribbon.

Figure 17:
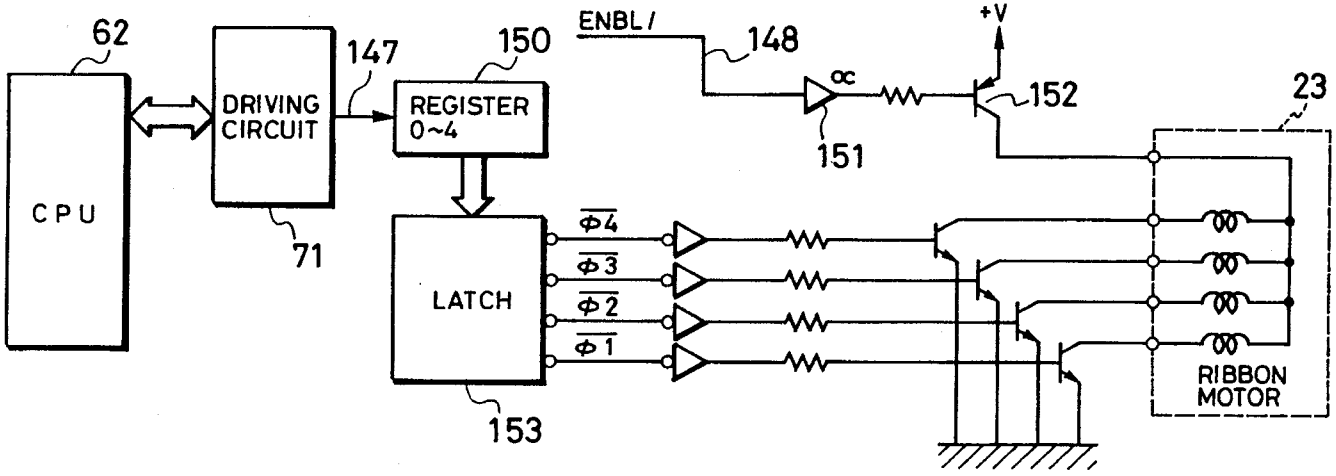
FIG. 17 is a block diagram of a ribbon motor driving circuit, construction of the driver and connection of the driver.

FIG. 17 is a block diagram showing the constructions of the driving circuit 71 for driving the ribbon motor 23 and the driver 76, as well as the connection therebetween.

One of the register Nos. 0 to 3 is selected in accordance with the select signal 147 from the driving circuit 71 shown in FIG. 15. The output of the selected register is delivered to and latched by a latch 153. The 4-bit signal from the selected register drives four NPN transistors thereby to excite the respective phases of the ribbon motor 23.

As shown in FIG. 16, each register of the register 150 stores signals for driving the ribbon motor 23 by exciting two phases thereof. When the content of the counter 144 changes incrementally, the ribbon motor 23 operates forwardly (winding or feeding direction), whereas, when the content of the counter 144 changes decrementally, the ribbon motor 23 operates backward (rewinding or reversing direction). The ENABLE signal ENBL/is input through an open collector driver 151 to an NPN transistor 152, so as to turn the driving power of the ribbon motor 23 on and off, so as to turn on and off the driving power supply for the ribbon motor 23, in such a manner as to supply the power to the ribbon motor 23 only when it is driven.

Figure 18:
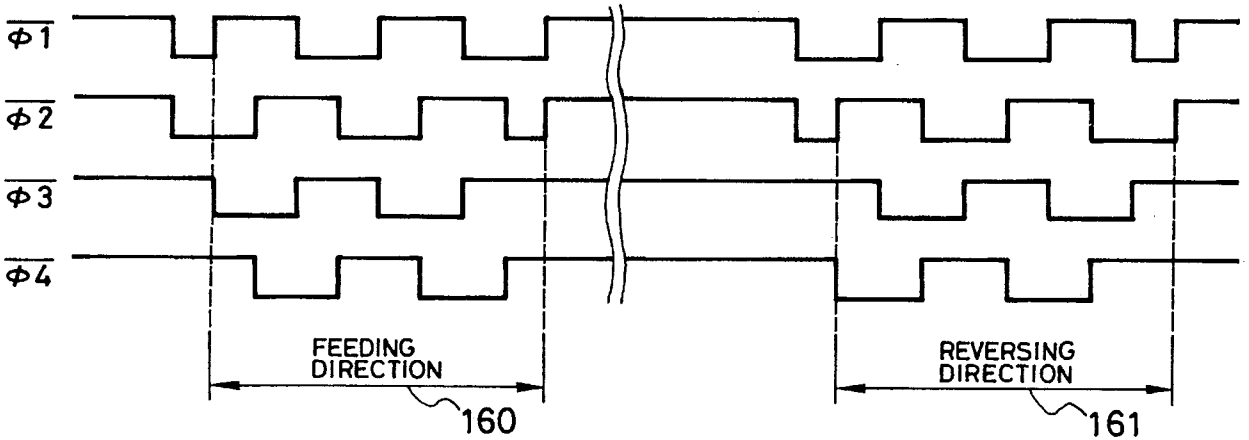
FIG. 18 is an illustration of the timing of an exciting signal for exciting the ribbon motor.

FIG. 18 illustrates an example of the timing of exciting signal for exciting the ribbon motor 23. In this Figure, a numeral 160 denotes an example of the exciting timing for enabling the ribbon motor 23 to take-up the ink ribbon by a length corresponding to 8 pulses, while a numeral 161 denotes the timing of excitation of the ribbon motor for rewinding or reversing the ink ribbon by a length corresponding to 8 pulses. The switching time for each excitation phase is determined by a value preset in the program timer 142.

FIG. 19 shows an arrangement of a circuit for generating the printing interruption signal which is delivered to the CPU 62.

When the printing timing signal 95 is delivered from the servo circuit 73 while the interruption enable signal 172 is ENABLE (low level), the D-type flip-flop 173 is set so that the interruption signal 170 is changed to high level, thereby generating interruption to the CPU 62. Thus, the CPU 62 can time the movement of the carriage 4 with the print data and delivers, on the basis of this timing, to the thermal head 3 through the driver 72. The D-type flip-flop 173 is reset by an interruption acknowledge signal 171 delivered from the CPU 162.

[Description of Control Operation (FIGS. 20 to 22)]

Figure 20:
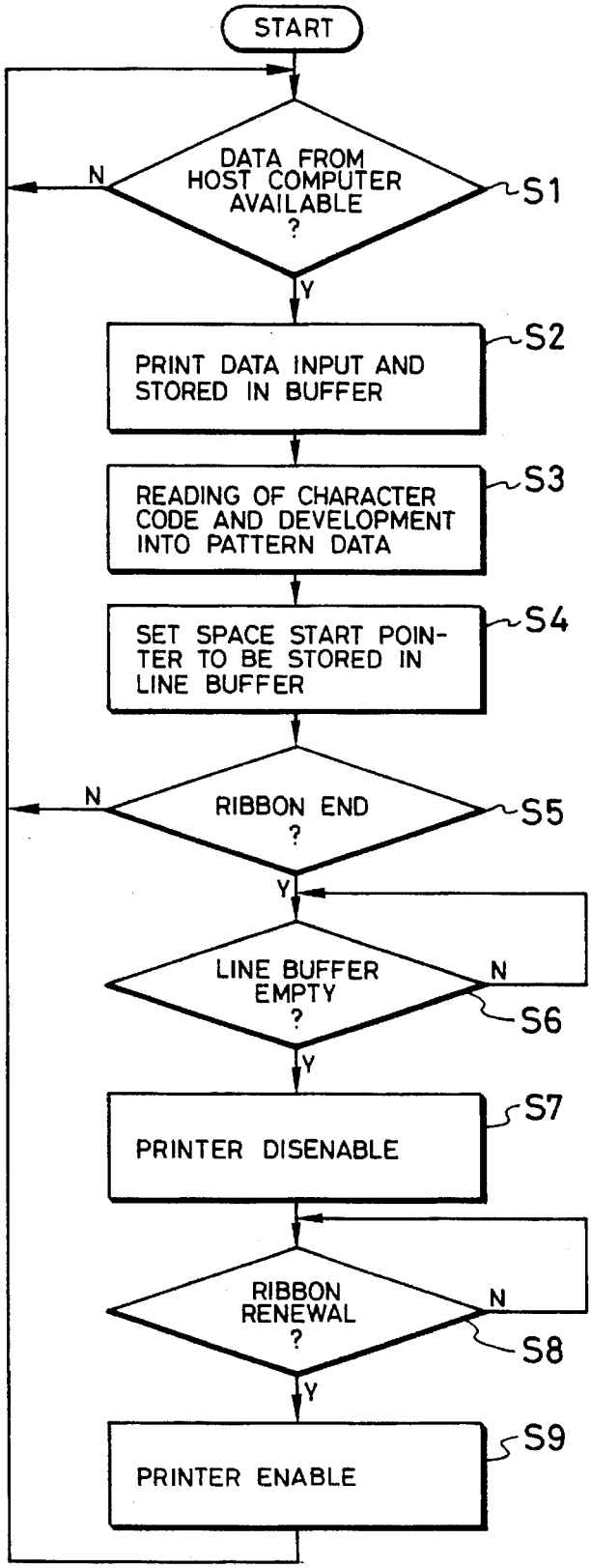
FIG. 20 is a flow chart of a program stored in a ROM of a thermal transfer printer in accordance with the present invention.

FIG. 20 shows a flow chart of a process for executing a program stored in the ROM 64 incorporated in the described embodiment of the thermal transfer printer.

In Step S 1, the CPU judges whether data corresponding to one character has been received from the host computer 60. Upon confirming the receipt of the data, the CPU stores this data in the form of character code in the buffer of the RAM 65 in Step S 2. In Step S 3, the character code is read from the buffer and is developed into pattern data by the pattern generator 63. In Step S 4, the dot pattern data obtained by development is stored in the line buffer 66. At the same time, position data representing the space portion (portion L4 in FIG. 10) on the right side of the character pattern read from the pattern generator 63 is set in a space start pointer of the RAM 65. The space start pointer stores this data in terms of the absolute position along the horizontal direction in which the carriage 6 moves. This data representing the space position is renewed each time a new character is input.

The printing operation of the printer is commenced after completion of Step S 4. The printing operation follows the interruption flow charts shown in FIGS. 21A and 21B.

In Step S 5, a judgment is conducted as to whether the ink ribbon has been exhausted. If the answer is NO, the process returns again to Step S 1. However, if the answer is YES, i.e., in case of "RIBBON END", the process proceeds to Step S 6 in which a judgment is conducted as to whether the line buffer 66 is empty, i.e., whether the printing of one character has been finished. In Step S 6, the CPU waits for the completion of the printing of the data stored in the line buffer 66. This step S 6 is executed because printing of at least one character is possible even in the "RIBBON END" state.

When the empty state of the line buffer 66 is confirmed in Step S 6, the process proceeds to Step S 7 in which the printer is disabled and Step S 8 is executed to wait for the renewal of ribbon. When the renewal of the ribbon is finished, the process proceeds to Step S 9 in which the printer is enabled. The process then returns to Step S 1 so that the above-described series of operation is repeated.

Figure 21A:
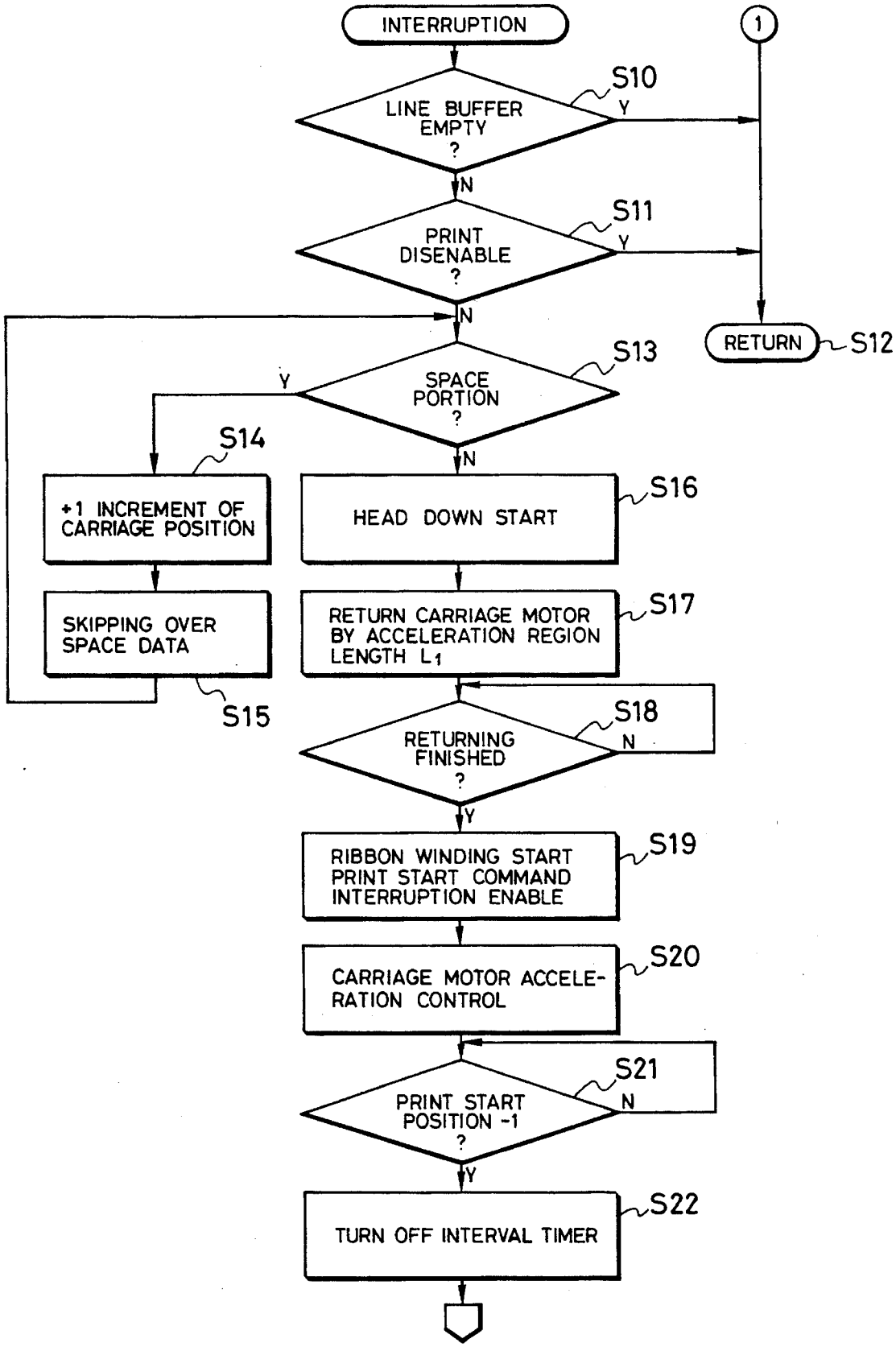
FIGS. 21A and B are a flow chart of a CPU interruption program started by an print start interruption signal.
Figure 21B:
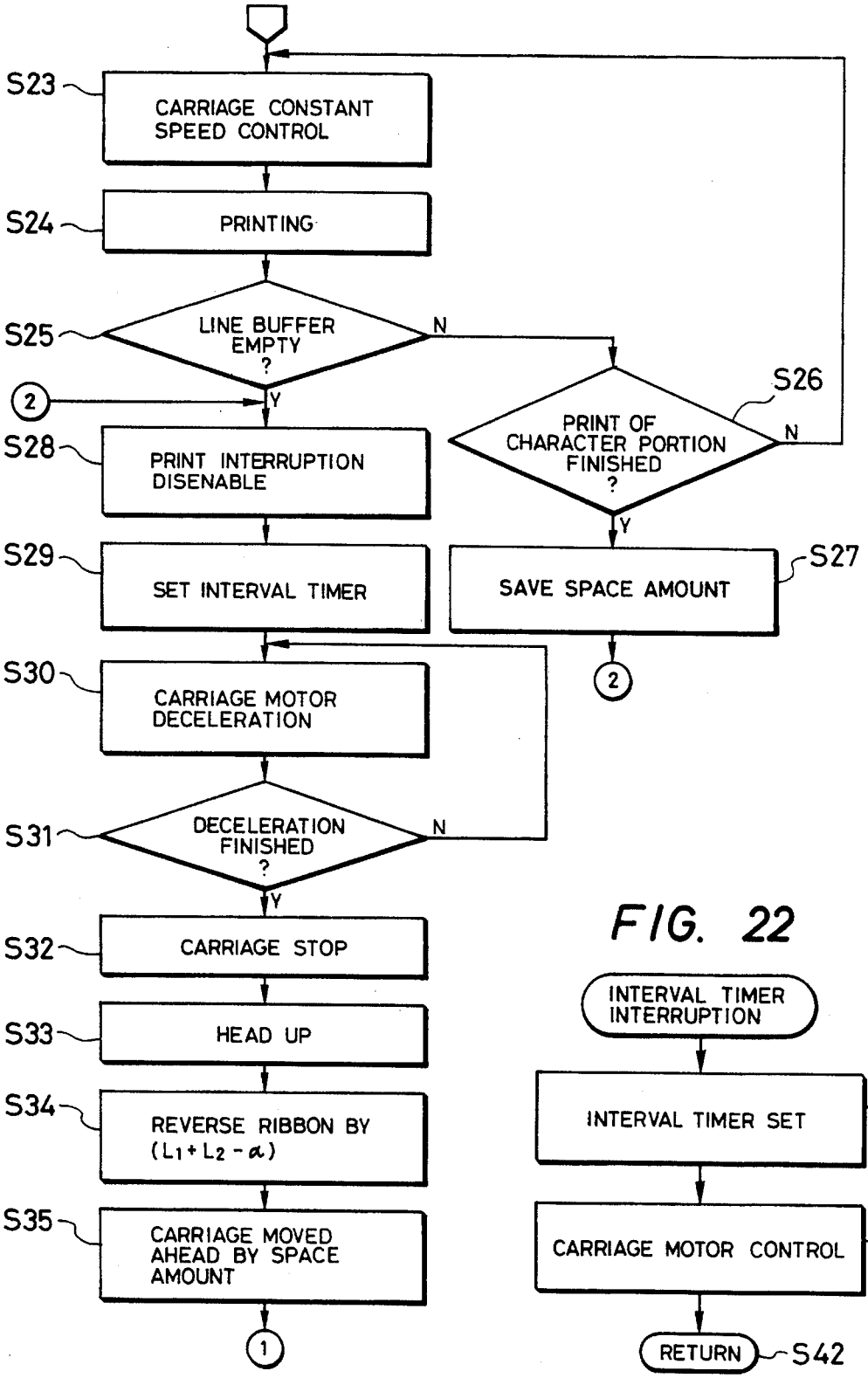

FIGS. 21A and 21B are flow charts showing the printing program which is to be conducted by the CPU in response to a software interruption for commencing printing. The software interruption is required to the CPU during process parallel to or in synchronism with other programs.

When the interruption is received, the process proceeds to Step S 10 in which a judgment is conducted as to whether the line buffer 66 is empty or not. When no pattern data is available in the line buffer 66, Step S 12 is executed so that the process is returned to the main routine. Conversely, when data is available in the print buffer 66, the process proceeds to Step S 11 in which a judgment is conducted as to whether the printer has been disabled. If the printer is ready for printing, the process proceeds to Step S 13 in which a search is commenced from the left end of the print buffer 66 so as to find a row having a black dot or dots, thus examining whether the print data is a space data having no black dot. If this print data is a space, the process proceeds to Step S 14 in which the carriage 6 is made to move ahead by a distance corresponding to one dot. In Step S 15, the space data is skipped over.

When any row having a black dot or dots is found, the process proceeds to Step S 16 in which the head actuator 11 commences head down operation for setting the thermal head 3 down. Then, in the subsequent step S 17, the carriage 6 is returned leftward by a distance corresponding to the length L1 of the region set for accelerating the carriage 6. In Step S 18, a judgment is conducted as to whether the carriage 6 has completed its backward movement through the distance L1. If the answer is YES, i.e., if the completion of backward movement of the carriage is confirmed, the process proceeds to Step S 19 in which a ribbon feeding command is delivered to the ribbon motor 23. At the same time, a print start command is generated to enable interruption by print timing (interruption signal 170 shown in FIG. 19). The ribbon feeding command changes the level of the rotation direction signal 145 to high level, and a time corresponding to the driving period of the ribbon motor 23 is set in the program timer 142. In Step S 20, a control is conducted to accelerate the carriage motor 8 so that the carriage runs the distance L1 while being accelerated and, in Step S 21, a judgment is conducted as to whether a position which is immediately before the print start position and spaced from one dot pitch from the latter has been reached by the carriage 6. In Step S 22, an interval timer is turned off and, in Step S 23, the carriage motor 8 is controlled to operate at a constant speed, thus commencing the steady running of the carriage 6 at the constant running speed.

In Step S 24, printing is conducted in accordance with the dot data read from the line buffer 66. More specifically, the dot data in the line buffer is transferred to the thermal head 3 so as to conduct the printing each time the interruption signal 170 shown in FIG. 19 is received. In Step S 25, a judgment is conducted as to whether the whole data stored in the line buffer 66 has been printed. If the answer is NO, i.e., if the print of the whole data in the line buffer 66 has not been finished yet, the process proceeds to Step S 26 in which a judgment is conducted as to whether the print of the character portion of the data has been finished, i.e., whether the instant position of the carriage is equal to the position indicated by the space start pointer set in the RAM 65 in Step S 4. When the position indicated by the space start pointer is reached, Step S 27 is executed in which the amount or length L4 of the space on the right side of the character is set in the RAM 64. When the line buffer 66 has become empty or when the printing of a character in the dot data is finished, the process proceeds to Step S 28 in which, since the printing has been finished, the interruption by the interruption signal 170 is disenabled, and the interval timer is set in Step S 29. In Steps S 30 and S 31, the carriage is decelerated while it runs the distance L2 and, after running this distance, the carriage 6 is stopped at Step S 32.

In Step S 33, a head up operation is conducted to raise the thermal head 3 away from the ink ribbon. In Step S 34, the rotation direction signal 145 is turned to low level and the value corresponding to the driving period of the ribbon motor 23 is set in the program timer 142, thereby to reverse the ink ribbon by an amount which is represented by {(acceleration distance)+(deceleration distance−α}. As explained before, α represents the margin which is set for the purpose of avoiding any overlap between the portion of the ink ribbon which has been used already and the portion of the ink ribbon which is going to be used.

In Step S 35, an operation is conducted to set the carriage 6 at the beginning of the region where the next character is to be printed. To this end, the carriage 6 is first moved leftward from the position where it has been stopped by an amount which corresponds to L2–L4, i.e., a value obtained by subtracting, from the length L2 of the region for decelerating the carriage 6, the amount or length L4 of the space on the right side of the character which has just been printed, the length L4 having been stored in Step S 27. As a result, in the case of printing of the character shown in FIG. 10, the carriage is set at a position where the row 3-1 of the resistors on the thermal head is located at a position indicated by a numeral 79. The operation for printing one character is thus completed.

Figure 22:
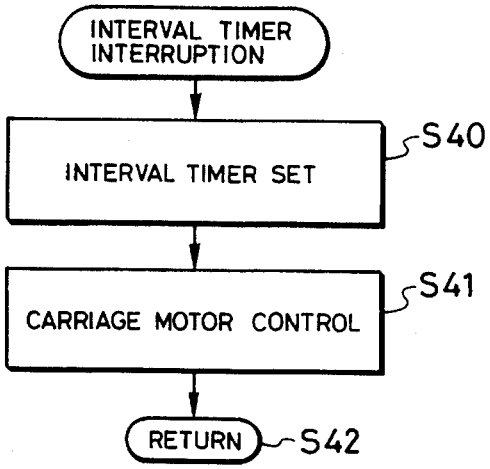
FIG. 22 is a flow chart of a carriage motor rotation control program.

FIG. 22 is a flow chart of the rotation control program of the carriage motor 8.

In Step S 40, the time interval of the control of the carriage motor 8 is set in the interval timer so that the interval timer delivers to the CPU 62 the interruption signal at the set time interval. When the interruption occurs in the CPU in response to the interruption signal, the process proceeds to Step S 41 in which carriage motor driving signal is output to conduct the control of operation of the carriage motor 8. Then, the process returns to the main routine via Step S 42. Thus, the servo control is conducted so as to control acceleration and deceleration of the carriage motor 8, as well as steady running of the same, at the time interval set in the interval timer.

From the foregoing description, it will be understood that, in the described embodiment of the present invention, the portion of the ink ribbon which has been fed without being actually used is reversed by rewinding operation so as to be used in the next printing operation, whereby the amount of ink ribbon wastefully used is minimized.

In addition, when the carriage skips over the region corresponding to the space portion of the character pattern data, the ink ribbon is not fed, so that the wasteful use of the ink ribbon is reduced.

The inventors have confirmed that the amount of the ink ribbon wastefully used, which has been typically about 100 m in case of an ink ribbon of 500 m long, is reduced to about 20 m, thus saving the ink ribbon in amount of about 80 m. Needless to say, the invention may be modified such that the feed of the ink ribbon is stopped not only in the regions corresponding to the spaces in each character pattern but also in the region corresponding to the space between two character patterns when the thermal head is moved to the position for printing the next character.

In the embodiment described hereinunder, the amount or length of the ink ribbon reversed or rewound is equal to or substantially equal to the detected amount or length of wasteful feed of the ink ribbon. This, however, is not exclusive and the invention includes such cases where the ink ribbon is reversed or rewound in an amount which corresponds to the detected amount of wasteful feed.

The advantage of the described embodiment is remarkable particularly when the electronic typewriter T to which the described embodiment is applied has a so-called character—character operation mode. The character—character operation mode is a mode in which printing is conducted such that each character is printed in response to the input of such a character through a key K or such that a plurality of successive characters are printed when the input of such characters through the keys is finished. Thus, in such an operation mode, the wasteful use of the ink ribbon at both sides of each character or at both ends of the train of characters is eliminated to ensure a higher economy.

Thus, the described embodiment remarkably reduces the amount of wasteful use of the ink ribbon.

A different embodiment of the present invention will be described hereinunder with reference to FIGS. 23 to 27. In this embodiment, when the recording or printing is finished, the ink ribbon is rewound or reversed in amount corresponding to the amount which has been wastefully fed without contributing to the printing as in the periods of acceleration and deceleration of the carriage, thus attaining an economical use of the ink ribbon.

Namely, in this embodiment, the ink ribbon is driven in such a method that it is rewound or reversed after head up operation in amount which corresponds to the sum of the amount of the ink ribbon fed in the period between the preceding head down operation and the starting of recording of the preceding character and the amount of the ink ribbon fed in the period between the completion of the recording of the preceding character and the head up operation.

The embodiment will be fully described with reference to the accompanying drawings.

Figure 24:
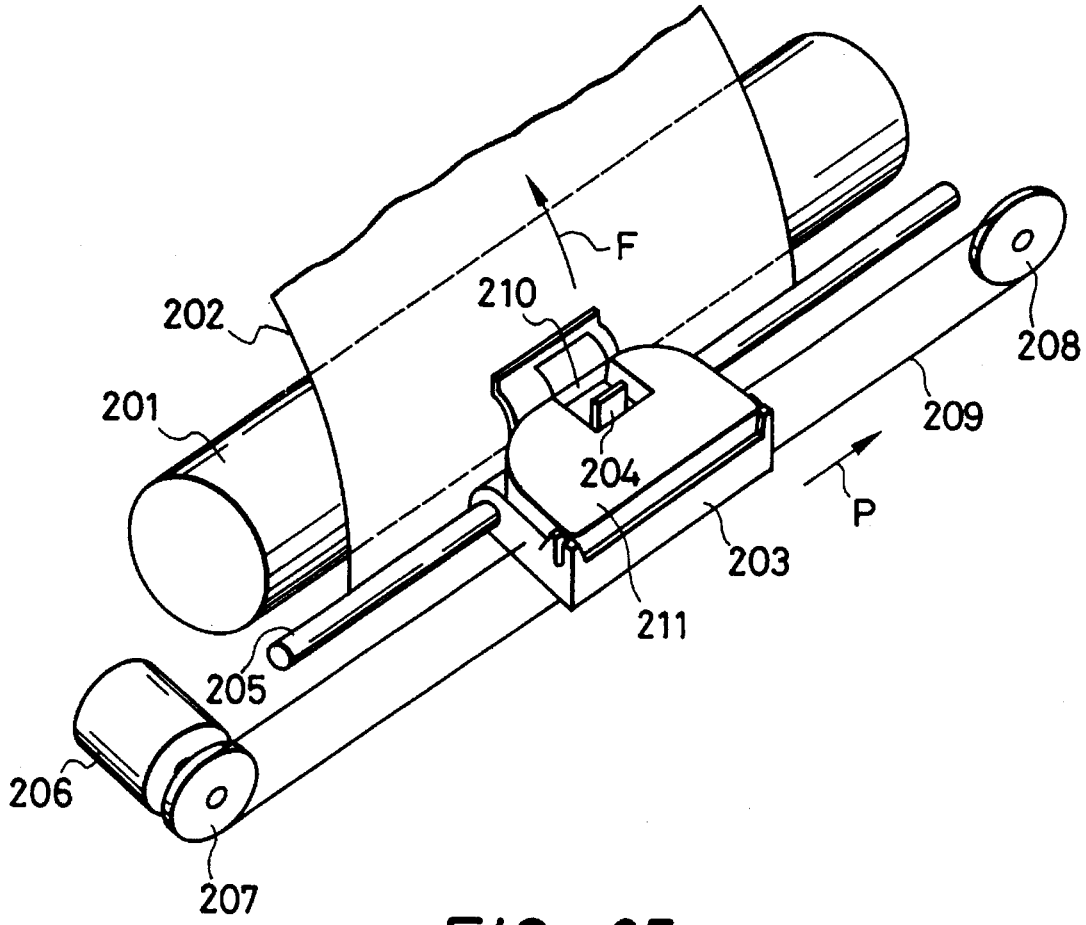
FIG. 24 is a schematic perspective view of a recording device suitable for carrying out the operation method shown in FIG. 23.

FIG. 24 shows a thermal transfer recording device in the form of an electronic typewriter suitable for carrying out the above-explained ink ribbon driving method.

Referring to FIG. 24, the electronic typewriter is so constructed that data is printed on a recording sheet 202 backed up by the platen 201 by means of a recording head (thermal head) 204 mounted on the carriage 203. The platen 201 is a roller-type platen which also serves as a roller for feeding the recording sheet 202. The carriage 203 is driven reciprocatorily along a guide shaft 205 which is disposed in parallel with the platen 201, by means of a carriage driving system which includes a carriage driving motor 206 which is a stepping motor, a driving pulley 207, a driven pulley 208, and a timing belt wound around these pulleys and connected to the carriage 203.

A ribbon cassette 211 is demountably mounted on the carriage 203 so as to feed an ink ribbon 210 through the gap between the thermal head 204 and the sheet 202. A print pattern generating means constituted by an array of a plurality of electricity-heat conversion elements such as heat-generating resistors is provided on the face of the thermal head 204 adjacent to the platen 201. The thermal head 204 is rockable with respect to the carriage 208 between a head down position in which it is pressed onto the pulley 201 through the intermediaries of the ink ribbon 210 and the recording sheet 202 and a head up position where it is spaced apart from the ink ribbon 210.

The ink ribbon 210 in the ribbon cassette 211 is adapted to be fed or wound in synchronization with the movement of the carriage when the carriage 203 in the head down position is moved.

The thermal head 204, when operated for the printing purpose, is moved along the platen in head down position and the ink ribbon 210 is fed in synchronization with the movement of the thermal head 204. Meanwhile, the electricity-heat conversion elements are selectively energized in accordance with the printing data thereby effecting the printing of characters or patterns in conformity with the printing data. After completion of data on each printing line, a line change operation is conducted by feeding the sheet 202 in the direction of the arrow F.

Figure 25:
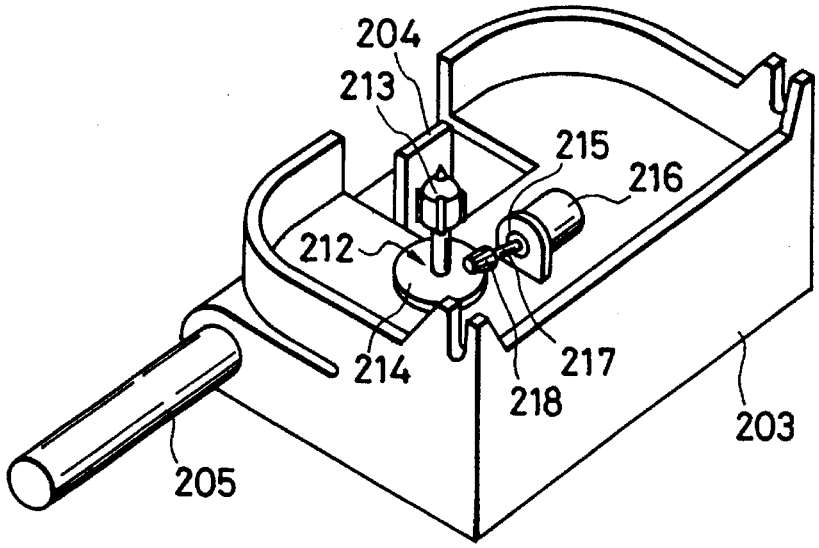
FIG. 25 is a partial perspective view of the ink ribbon driving mechanism shown in FIG. 24.

FIG. 25 is an illustration of the carriage 203 after removal of the ribbon cassette 211, thus showing the mechanism for driving the ink ribbon. A vertical ribbon winding shaft 212 is rotatably mounted on the carriage 203, as will be seen from FIG. 25. An engaging portion 213 is formed on the end of the ribbon winding shaft 212 which extends into the ribbon cassette 211 so as to make a torque-transmitting engagement with a ribbon winding core. A gear 214 is provided on the base portion of the ribbon winding shaft 212. The ribbon winding stepping motor 216 is secured to the carriage 203 through a flange 215. The ribbon winding motor 216 has an output shaft 217 to the end of which is fixed a pinion 218 which engages with the gear 214 on the base of the ribbon winding shaft 212.

It is therefore possible to control the driving of the ink ribbon, i.e., the moving direction and speed of the ink ribbon 210, by controlling the rotation of the ribbon winding motor 216.

Figure 26:
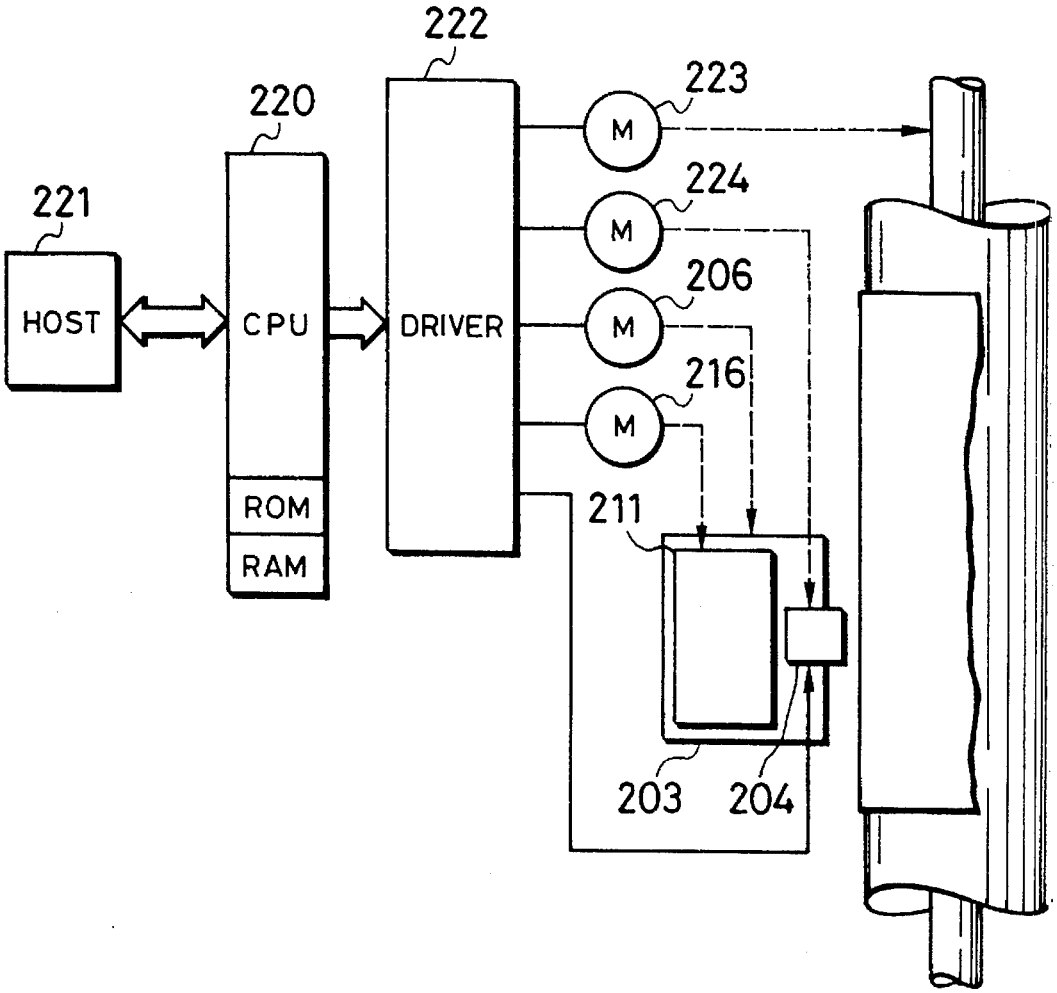
FIG. 26 is a block diagram of a control system suitable for carrying out the method of the present invention.

FIG. 26 is a block diagram of a control system suitable for carrying out the described method of controlling the thermal transfer recording device.

Referring to FIG. 26, the recording device has a control circuit 220 which is in this case a CPU (Central Processing Unit). The CPU 220 receives various command and data signals from a host machine 221 such as a computer or a word processor. Upon receipt of these signals, the CPU 220 delivers various signals for driving the carriage driving motor 206, sheet feed motor 223, ribbon winding motor 216 and a head up/down motor 224, through a driver 222.

The driver 222 also selectively drives a plurality of electricity-heat conversion elements on the thermal head 204 in accordance with the print data signal derived from the CPU 220, thereby to form the desired printing pattern on the recording sheet 202.

The CPU 220 is provided with a ROM for storing various control programs and a RAM for temporarily storing data and command signals.

Figure 27:
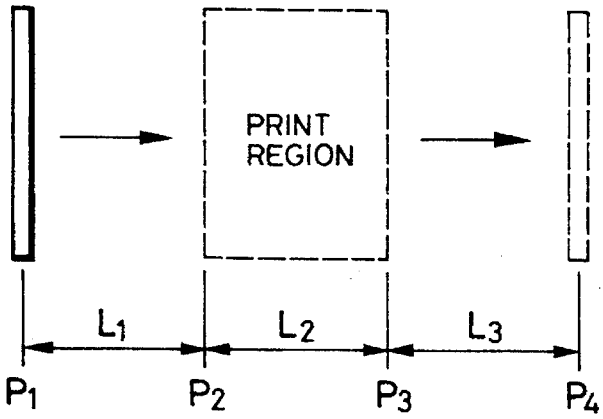
FIG. 27 is an illustration of a carriage accelerating region, constant speed region and a carriage decelerating region.

Referring now to FIG. 27 which shows the operations performed by various parts of the device in relation to the position of the carriage 203, P1 represents the position of the carriage 203 at which the thermal head is put down while the running speed of the carriage is still zero. The acceleration of the carriage 203 is completed in the region of a length L1 from the position P1 so that the carriage speed reaches a predetermined constant speed at a position P2 where the recording is commenced. Thus, the recording is conducted in the region of a length L2 from the position P2 while the carriage 203 runs at the predetermined constant speed and the recording (printing) is finished when the carriage 203 has reached a position P3 which is spaced from the position P2 by the length L2.

After the recording is finished upon arrival of the carriage at the position P3, the carriage 203 is decelerated in a region of a length L3 and the carriage speed is reduced to zero when the carriage has run the distance L3 to arrive at a position P4 where the head up operation is conducted. Then, the carriage 203 waits for the command for printing next character or data and the above-described control of the carriage is repeated after any necessary operation such as the line change operation.

In the region between the positions P1 and P4, the thermal head 204 is pressed onto the platen 201 through the intermediary of the ink ribbon 210 and the recording sheet 202, so that the ink ribbon 210 is inevitably fed in synchronization with the movement of the carriage 203 carrying the thermal head. Thus, at least the carriage acceleration and deceleration regions L1 and L3 correspond to the length of the ink ribbon which is fed wastefully without contributing to the recording.

The ink ribbon driving method realized in this embodiment eliminates the above-explained wasteful use of the ink ribbon, by reversing or rewinding the ink ribbon 210 by an amount corresponding to the sum (L1+L3) of the lengths of the acceleration and deceleration regions, after the head up operation at the position P4 is finished.

Thus the method of this embodiment is to reverse or rewind, after completion of head up operation conducted subsequent to recording, the ink ribbon in an amount which corresponds to the sum of the amount of the ink ribbon fed during the movement of the carriage through the acceleration region L1 between the head down position P1 and the recording start portion P2 and the amount of the ink ribbon fed during the movement of the carriage through the deceleration region L3 between the recording finish position P3 and the head up portion P4.

The reversing of the ink ribbon 210 is effected by the power derived from the ribbon winding stepping motor 216. In this case, however, the pattern of excitation of this motor is altered from that for the forward feed, so as to operate the motor 216 in the reversing direction.

Figure 23:
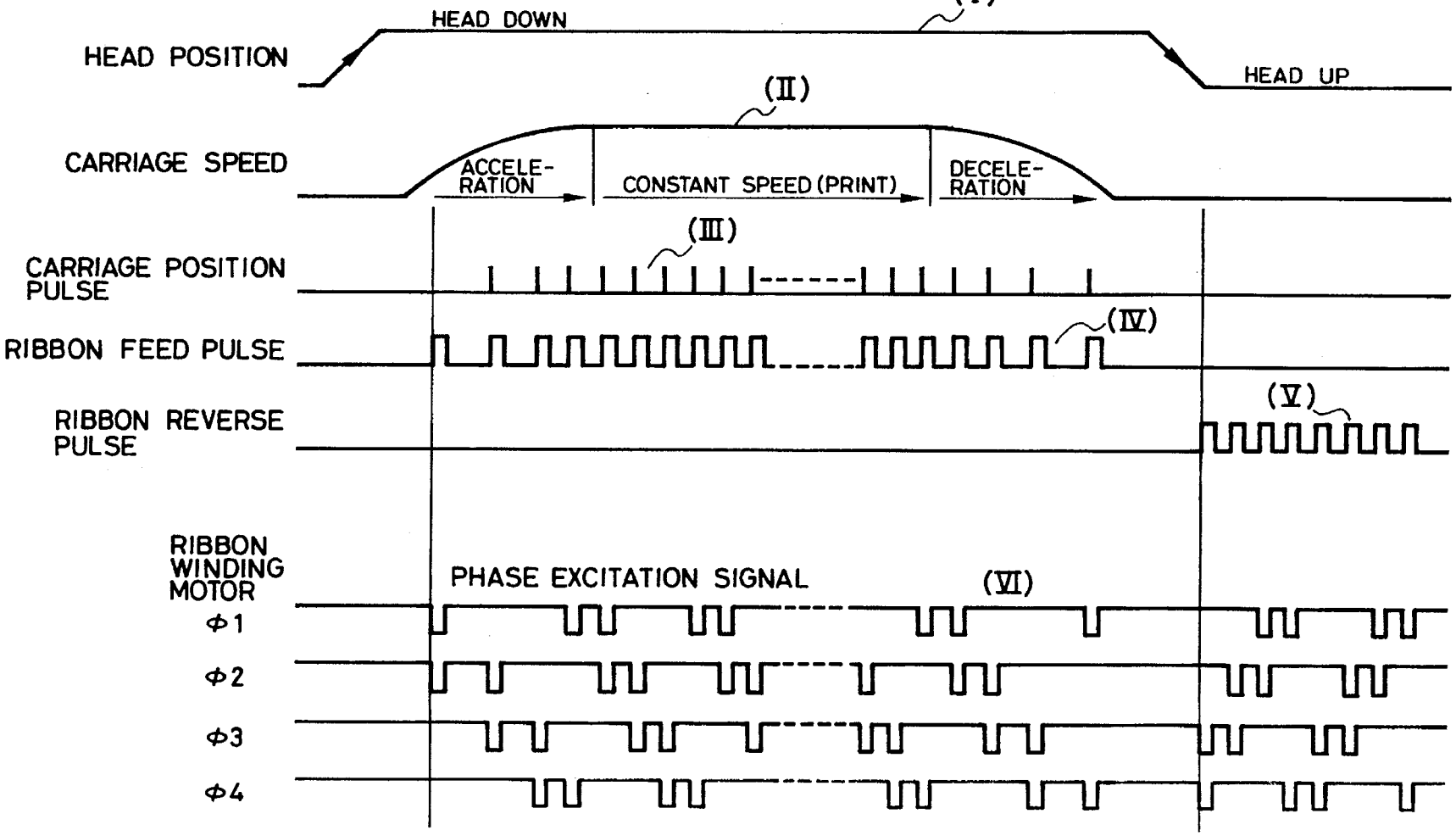
FIG. 23 is a timing chart showing the operation of a different embodiment making use of a different ink ribbon driving method.

FIG. 23 is a timing chart explaining the series of operation such as the head up/down, running of carriage and feeding and reversing of the ink ribbon.

More specifically, FIG. 23 includes a plurality of charts: namely, a chart (I) illustrating the timing of head up (0) and head down (1) operation of the thermal head 204; a chart (II) showing the running speed characteristic of the carriage 203; a chart (III) showing position pulses generated at a constant interval of length traveled by the carriage 203; a chart (IV) showing the driving pulse for driving the ribbon winding motor 216; a chart (V) showing the driving pulse for reversing the ribbon winding motor 216 for the purpose of reversing the ink ribbon after head up operation; and a chart (VI) showing the excitation signals for exciting the respective phases $\phi_1$ to $\phi_4$ of the ribbon winding stepping motor 216.

The ink ribbon driving method of this embodiment will be explained with reference to the timing chart shown in FIG. 23.

The carriage driving motor 206 starts to operate so as to commence acceleration of the carriage 203, after the thermal head 204 is put down into pressure contact with the platen 201 through the intermediary of the ink ribbon and the recording sheet. During the movement of the carriage 203, a carriage position pulse as shown by the chart (III) is generated for each travel of the carriage 203 through a predetermined distance which is, for example, 1/360 inch. In response to each carriage position pulse, a ribbon winding pulse is generated in synchronism with the carriage position pulse as shown in the chart (IV) so as to drive the ribbon winding motor 216 in the forward direction, i.e., in the direction for winding and feeding the ink ribbon, in synchronization with the movement of the carriage 203.

In the illustrated case, the length or amount of the ribbon fed during the travel of the carriage through the acceleration region corresponds to 4 pulses. Assuming here the interval of the carriage position pulse corresponds to 1/360 inch, the length of the ink ribbon fed during the carriage acceleration amounts to 4/360 inches.

The recording is conducted during running of the carriage at the constant speed after the acceleration and deceleration of the carriage 203 is commenced when the recording is finished.

In the illustrated case, the ink ribbon is fed also in amount corresponding to four pulses during deceleration of the carriage 203. Thus, the ink ribbon is fed by a length of 4/230 inches wastefully also in the deceleration region.

In consequence, in the illustrated case, the ink ribbon is wastefully fed in amount of 8/360 inches which is the sum of the length fed during acceleration between the head down position and the recording start position and the length fed during deceleration between the recording finish position and the head up position.

In this embodiment, therefore, after the head up operation is completed to set the thermal head 204 at the position spaced from the ink ribbon 210 following the deceleration and stop of the carriage, 8 (eight) reversing pulses are fed to the ribbon winding motor 216 thereby to reverse the ink ribbon 210 by 8/360 inches.

The ribbon winding pulse shown in the chart (IV) and the ribbon reversing pulse shown in the chart (V) can be delivered through the same signal path. In FIG. 23, however, these pulses are shown in separate charts, for the purpose of clarification of these two types of pulses.

As will be clearly undetstood from the chart (VI) which shows the timing of phase excitation of the ribbon winding motor 216, the ribbon winding motor 216 used in this embodiment has four excitation phases $\phi_1$ to $\phi_2$, and the motor 216 operates as these phases are successively excited in two-phase excitation type method. Thus, the direction of operation of this motor can easily be altered simply by altering the excitation pattern as illustrated.

As will be understood from the foregoing description, in this embodiment of the invention, a reversible motor is used as the motor for feeding and reversing the thermal transfer ink ribbon and, after the thermal head has been moved up away from the ink ribbon, the ink ribbon is reversed in amount corresponding to the sum of the amount of the ink ribbon fed during the acceleration of carriage between the head down position and the recording start position and the amount of the ink ribbon fed during deceleration of the carriage between the recording finish position and the head up position. In consequence, the amount of the wasteful feed of the ink ribbon during acceleration and deceleration of the carriage is compensated for, thus affording an economical use of the ink ribbon.

The described advantage is remarkable particularly in the case of transfer type recording devices operable in a mode in which the printing is conducted in a character-by-character fashion, e.g., the electronic typewriter as shown in FIG. 1.

As will be understood from the foregoing description, in the recording device of the present invention, the ink ribbon is reversed after completion of head up operation, in an amount which corresponds to the sum of the amount of the ink ribbon wastefully fed during the travel of the carriage between the head down position and the recording start position and the amount of the ink ribbon wastefully fed during travel of the carriage between the recording finish position and the head up position, whereby the wasteful use of the ink ribbon is eliminated to ensure a high economy.

Although a narrow ink ribbon has been specifically mentioned in the foregoing description of embodiments, this is only illustrative and the invention can be carried out equally well when a wider ink ribbon is used as the ink sheet. It is also to be understood that the invention can be applied also to a thermal recording device of the type in which electric power is selectively supplied to an ink sheet so as to selectively energize electrodes in the ink sheet thereby to generate heat at selection points on the ink sheet, although the foregoing description of the embodiment specifically mentioned to devices of the type in which ink ribbons are externally heated by the thermal heads. The ink used in the invention may be any known ink of heat-meltable or heat-sublimatable type. In addition, recording mediums other than the described recording or printing paper sheet, such as a plastic transparency for use in an overhead projector, may be used equally well.

In consequence, the present invention provides a thermal recording device which is capable of minimizing wasteful use of an ink ribbon or sheet used in the device.

We claim:

1. A thermal recording apparatus for recording on a recording medium by using an ink sheet having an ink, said apparatus comprising:

a carriage for moving a thermal head having a heat generating element and the ink sheet in a direction across a conveyance direction of said recording medium;

a conveying mechanism for conveying said ink sheet along an ink sheet conveying route in a first direction and also in a second direction opposite to said first direction, said first direction being a conveyance direction of said ink sheet during recording of a pluality of characters on a line by heating of said heat generating element;

a head actuator for driving said thermal head to a down position and to an up position, wherein said thermal head is in contact with said ink sheet when in the down position and is spaced apart from said ink sheet when in the up position;

a head actuator control unit for controlling said head actuator so that said thermal head is driven to the down position before each of the plurality of characters on a line is recorded, and so that said thermal head is driven to the up position after each said character is recorded;

an ink sheet conveyance control unit for controlling the conveying mechanism so that, in the recording of each of the plurality of characters on a line, said ink sheet is conveyed in said first direction while said carriage is accelerated from a stopped condition to a predetermined speed from a side of a region where said heat generating element is heated, is moved at said predetermined speed to record one character, is decelerated from said predetermined speed and is stopped, and said ink sheet is conveyed in said second direction a distance given by $(L_1+L_2-\alpha)$ after said carriage is stopped, where $L_1$ is a distance from a point where the acceleration of said carriage starts to a point where the heat generating element is heated to record one character, $L_2$ is a distance from a point where the heating of said heat generating element is finished to a point where said carriage is stopped, and $\alpha$ is a distance representing an amount of adjustment of the conveyance of said ink sheet so as to prevent overlap between a region of said ink sheet already used for recording of one character and a region of said ink sheet to be used for subsequent recording; and a slackness absorbing portion for absorbing a slackness of said ink sheet, said slackness occurring when said ink sheet is caused to be conveyed in said second direction, said slackness absorbing portion being provided in the ink sheet conveying route upstream of said recording area determined with respect to said conveying direction of said ink sheet.

2. A thermal recording apparatus according to claim 1, wherein said slackness absorbing portion comprises:

a pivotable lever mounted on a shaft; and a spring for biasing said lever against said ink sheet.

3. A thermal recording apparatus according to claim 1, wherein said thermal head records by one character unit at a time.

4. A thermal recording apparatus according to claim 1, wherein said control unit causes said ink sheet to be conveyed in said second direction after completion of the recording.

5. A thermal recording apparatus according to claim 1, wherein said thermal head starts recording following a time period after said ink sheet begins to be conveyed by said conveying mechanism, said time period corresponding to an acceleration period of said carriage moving said ink sheet and said thermal head, said carriage being capable of reciprocally moving across said recording medium.

6. A thermal recording apparatus according to claim 1, wherein after said thermal head finishes recording a time period passes before ink sheet conveying terminates, the time period corresponding to a time required for deceleration of said carriage moving the ink sheet and the recording means, the carriage being movable across the recording medium.

7. An apparatus according to claim 1, wherein said slackness absorbing portion is provided on an ink sheet cassette detachably mounted on an apparatus body.

8. A thermal recording apparatus as in claim 1 wherein said ink sheet is conveyed in said second direction by a second distance which is a predetermined distance less than said distance.

9. A thermal recording apparatus for recording on a recording medium by using an ink sheet having an ink, said apparatus comprising:

a carriage for moving a thermal head having a heat generating element and the ink sheen in a direction across a conveyance direction of said recording medium;

a conveying mechanism for conveying said ink sheen along an ink sheet conveying route in a first direction and also in a second direction opposite to said first direction, said first direction being a conveyance direction of said ink sheen during recording of a plurality of characters on a line by heating of said heat generating element;

a head actuator for driving said thermal head to a down position and to an up position, wherein said thermal head is in contact with said ink sheet when in the down position and is spaced apart from said ink sheet when in the up position;

a head actuator control unit for controlling said head actuator so that said thermal head is driven to the down position before each of the plurality of characters on a line is recorded, and so that said thermal head is driven to the up position after each said character is recorded; and an ink sheet conveyance control unit for controlling the conveying mechanism so that, in the recording of each of the plurality of characters on a line, said ink sheet is conveyed in said first direction while said carriage is accelerated from a stopped condition to a predetermined speed from a side of a region where said heat generating element is heated, is moved at said predetermined speed to record one character, is decelerated from said predetermined speed and is stopped, and said ink sheet is conveyed in said second direction a distance given by $(L_1+L_2-\alpha)$ after said carriage is stopped, where $L_1$ is a distance from a point where the acceleration of said carriage starts to a point where the heat generating element is heated to record one character, $L_1$ is a distance from a point where the heating of said heat generating element is finished to a point where said carriage is stopped, and $\alpha$ is a distance representing an amount of adjustment of the conveyance of said ink sheen so as to prevent overlap between a region of said ink sheet already used for recording of one character and a region of said ink sheet to be used for subsequent recording.

10. A thermal recording apparatus according to claim 9, wherein said control unit causes said ink sheet to be conveyed in said second direction by a distance which is shorter than a space area, said space area having a size which is the difference in length between an image area and a surrounding image pattern area and being disposed at both ends of the image area within the image pattern area, by a margin which is dimensioned so that during recording no portion of said ink sheet having a region which has already been used for recording is subsequently superposed atop said recording medium for recording.

11. A thermal recording apparatus according to claim 9, wherein said thermal head records by one character unit at a time.

12. A thermal recording apparatus according to claim 9, wherein said control unit causes said conveying mechanism to convey said ink sheet in said second direction after completion of the recording.

13. A thermal recording apparatus according to claim 9, further comprising a pattern generator for storing an image pattern and a space area, said space area having a size which is the difference in length between an image area and a surrounding image pattern area, where said space area is disposed at both ends of the image area within the image pattern area, and is included in a left and a right side of said image pattern area.

14. A thermal recording apparatus as in claim 9 wherein said ink sheet is conveyed in said second direction by a second distance which is a predetermined distance less than said distance.

15. A method of conveying an ink sheen in a thermal recording apparatus for recording on a recording medium by using an ink sheet having an ink, said apparatus comprising:

a carriage for moving a thermal head having a heat generating element and the ink sheet in a direction across a conveyance direction of said recording medium;

a heat actuator for driving said thermal head to a dawn position and to an up position, wherein said thermal head is in contact with said ink sheet when in the down position and is spaced apart from said ink sheet when in the up position; and a conveying mechanism for conveying said ink sheet along an ink sheet conveying route in a first direction and also in a second direction opposite to said first direction, said first direction being a conveyance direction of said ink sheet during recording by heating of said heat generating element;

said method comprising:

a first step of accelerating said carriage from a stopped condition to a predetermined speed from a side of a region where said heat generating element is heated and driving said thermal head to the down position when acceleration of said carriage is begun, while said ink sheet is conveyed in said first direction;

a second step of moving said carriage at said predetermined speed to record one character of a plurality of characters on a line, while said ink sheet is conveyed in said first direction;

a third step of decelerating and stopping said carriage from said predetermined speed and driving said thermal head to the up position when said carriage is stopped, while said ink sheet is conveyed in said first direction; and a fourth step of conveying said ink sheet a distance given by $(L_1+L_2-\alpha)$ in said second direction after said carriage is stopped, where $L_1$ is a distance from a point where the acceleration of said carriage starts to a point where the heat generating element is heated to record one character, $L_2$ is a distance from a point where the heating of said heat generating element is finished to a point where said carriage is stopped, and $\alpha$ is a distance representing an amount of adjustment of the conveyance of said ink sheet so as to prevent overlap between a region of said ink sheet already used for recording of one character and a region of said ink sheet to be used for subsequent recording.

16. A method of conveying an ink sheet in a thermal recording apparatus according to claim 15, wherein said thermal head records by one character unit at a time.

17. A method of conveying an ink sheet in a thermal recording apparatus according to claim 15, wherein said ink sheet is conveyed in said second direction after completion of the recording.

18. A method of conveying an ink sheet in a thermal recording apparatus according to claim 15, wherein said thermal head starts recording following a time period after said ink sheet begins to be conveyed by said conveying mechanism, said time period corresponding to an acceleration period of said carriage moving said ink sheet and said thermal head, said carriage being capable of reciprocally moving across said recording medium.

19. A method of conveying an ink sheet in a thermal recording apparatus according to claim 15, wherein after said thermal head finishes recording a time period passes before ink sheet conveying terminates, the time period corresponding to a time required for deceleration of said carriage moving the ink sheet and the recording means, the carriage being movable across the recording medium.

20. A method of conveying an ink sheet in a thermal recording apparatus as in claim 15, wherein said ink sheet is conveyed in said second direction by a second distance which is a predetermined distance less than said distance.

21. A thermal transfer recording method for pressing an ink ribbon to a recording sheet by a thermal head and thermal-transferring ink of said ink ribbon to said recording sheet, said method comprising:

a pro-thermal transferring step of winding and driving said ink ribbon, before a recording of each of a plurality of characters on a line, in a conveyance direction from a stopped condition until a conveying speed of said ink ribbon reaches a conveying speed during the recording, said conveyance direction being a conveyance direction during the recording, and pressing said recording sheet through said ink ribbon by said thermal head;

a thermal transferring step of winding and driving said ink ribbon in the conveyance direction during recording and thermal-transferring the ink of the ink ribbon to said recording sheet by said thermal head;

a post-thermal transferring step of winding and driving said ink ribbon in the conveyance direction during recording and stopping said ink ribbon and releasing the pressing by said thermal head to said recording sheet through said ink ribbon; and a rewinding step of rewinding said ink ribbon by a length less than a total length of a conveyance length of said ink ribbon conveyed at said pre-thermal transferring step and a conveyance length of said ink ribbon conveyed at said post-thermal transferring step in a direction opposite to the conveyance direction during recording.

* * * * *

UNITED STATES PATENT AND TRADEMARK OFFICE

CERTIFICATE OF CORRECTION

PATENT NO. : 5,533,819

DATED : July 9, 1996

INVENTOR(S) : YOUICHI WATANABE ET AL.

It is certified that error appears in the above-identified patent and that said Letters Patent is hereby corrected as shown below:

ON TITLE PAGE : Item

[30] FOREIGN APPLICATION PRIORITY DATA

"Feb. 12, 1986 [JP] Japan .... 61-215156" should read --Sept. 12, 1986 [JP] Japan .... 61-215156--.

Item:

[56] REFERENCES CITED - FOREIGN PATENT DOCUMENTS

Insert --60-253563- 12/1985 Japan--.

COLUMN 1

Line 63, "the the" should read --the--.

COLUMN 3

Line 48, "Nos, 0" should read --Nos. 0--.

Line 61, "an" should read --a--.

COLUMN 8

Line 15, "beg" should read --be--.

COLUMN 11

Line 8, "mark" should read --mark /--.

UNITED STATES PATENT AND TRADEMARK OFFICE

CERTIFICATE OF CORRECTION

PATENT NO. : 5,533,819

DATED : July 9, 1996

INVENTOR(S) : YOUICHI WATANABE ET AL.

It is certified that error appears in the above-identified patent and that said Letters Patent is hereby corrected as shown below:

COLUMN 21

Line 23, "sheen" should read --sheet--.
Line 26, "sheen" should read --sheet--.
Line 30, "sheen" should read --sheet--.
Line 58, "$L_1$" should read --$L_2$--.
Line 64, "sheen" should read --sheet--.

UNITED STATES PATENT AND TRADEMARK OFFICE

CERTIFICATE OF CORRECTION

PATENT NO. : 5,533,819

DATED : July 9, 1996

INVENTOR(S) : YOUICHI WATANABE ET AL.

It is certified that error appears in the above-identified patent and that said Letters Patent is hereby corrected as shown below:

COLUMN 22

Line 30, "sheen" should read --sheet--.

Line 37, "dawn" should read --down--.

Line 36, "heat" should read -- head --.

COLUMN 24

Line 6, "pro-thermal" should read --pre-thermal--.

Signed and Sealed this

First Day of April, 1997

Bruce Lehman

BRUCE LEHMAN

*Commissioner of Patents and Trademarks*

*Attest:*

*Attesting Officer*